US006319338B1

(12) United States Patent
Kawano et al.

(10) Patent No.: US 6,319,338 B1
(45) Date of Patent: Nov. 20, 2001

(54) HIGH-STRENGTH STEEL PLATE HAVING HIGH DYNAMIC DEFORMATION RESISTANCE AND METHOD OF MANUFACTURING THE SAME

(75) Inventors: Osamu Kawano; Yuzo Takahashi; Junichi Wakita; Hidesato Mabuchi, all of Oita; Manabu Takahashi, Futtsu; Akihiro Uenishi, Futtsu; Riki Okamoto, Futtsu; Yukihisa Kuriyama, Futtsu; Yasuharu Sakuma, Kimitsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/308,986

(22) PCT Filed: Nov. 28, 1997

(86) PCT No.: PCT/JP97/04359

§ 371 Date: Jul. 6, 1999

§ 102(e) Date: Jul. 6, 1999

(87) PCT Pub. No.: WO98/23785

PCT Pub. Date: Apr. 6, 1998

(30) Foreign Application Priority Data

Nov. 28, 1996 (JP) ..... 8-331380
Jan. 29, 1997 (JP) ..... 9-028296

(51) Int. Cl.[7] ..... C22C 33/08; C22C 38/00

(52) U.S. Cl. ..... 148/328; 148/320; 148/544; 148/545; 148/546; 148/547; 148/548

(58) Field of Search ..... 148/320, 328, 148/544, 545, 546, 547, 548

(56) References Cited

U.S. PATENT DOCUMENTS 5,030,298 * 7/1991 Kawano et al. ..... 148/12 F
5,470,403 * 11/1995 Yoshinaga et al. ..... 148/330
5,505,796 * 4/1996 Kawano et al. ..... 148/546
5,618,355 * 4/1997 Koyama et al. ..... 148/320
6,063,214 * 5/2000 Fujinaga et al. ..... 148/602

FOREIGN PATENT DOCUMENTS

401184226A * 7/1989 (JP) ..... C21D/8/02

* cited by examiner

*Primary Examiner*—Daniel J. Jenkins
(74) *Attorney, Agent, or Firm*—Kenyon & Kenyon

(57) ABSTRACT

The object of the present invention is to provide high-strength steel sheets exhibiting high impact energy absorption properties, as steel materials, to be used for shaping and working into such parts as front side members of automobiles which absorb impact energy upon collision, as well as a method for their production. The high-strength steel sheets of the invention which exhibit high impact energy absorption properties are high-strength steel sheets with high flow stress during dynamic deformation characterized in that the microstructure of the steel sheets in their final form is a composite microstructure of a mixture of ferrite and/or bainite, either of which is the dominant phase, and a third phase including retained austenite at a volume fraction between 3% and 50%, wherein the average value σdyn (MPa) of the flow stress in the range of 3~10% of equivalent strain when deformed in a strain rate range of $5\times10^{2}$~$5\times10^{3}$ (1/sec) after pre-deformation of greater than 0% and less than or equal to 10% of equivalent strain, satisfies the inequality: $\sigma dyn \geqq 0.766\times TS+250$ as expressed in terms of the maximum stress TS (MPa) in the static tensile test as measured in a strain rate range of $5\times10^{-4}$~$5\times10^{-3}$ (1/s) without deformation, and the work hardening coefficient between 1% and 5% of a strain is at least 0.080.

11 Claims, 5 Drawing Sheets

HIGH-STRENGTH STEEL PLATE HAVING HIGH DYNAMIC DEFORMATION RESISTANCE AND METHOD OF MANUFACTURING THE SAME

TECHNICAL FIELD

The present invention relates to high strength hot rolled and high strength cold rolled steel sheets having high flow stress during dynamic deformation, which can be used for automotive members and the like to provide assurance of safety for passengers by efficiently absorbing the impact energy of a collision, as well as a method for producing the same.

BACKGROUND ART

In recent years, protection of passengers from automobile collisions has been acknowledged as an aspect of utmost importance for automobiles, and hopes are increasing for suitable materials exhibiting excellent high-speed deformation resistance. For example, by applying such materials to front side members of automobiles, the energy of frontal collisions may be absorbed as the materials are crushed, thus alleviating the impact on passengers.

Since the strain rate for deformation undergone by each section of an automobile upon collision reaches about $10^3$ (l/s), consideration of the impact absorption performance of a material requires knowledge of its dynamic deformation properties in a high strain rate range. Because it is also essential to consider at the same time such factors as energy savings and $CO_2$ exhaust reduction, as well as weight reduction of the automobile, requirements for effective high-strength steel sheets are therefore increasing.

For example, in CAMP-ISIJ Vol. 9 (1996), pp.1112–1115 the present inventors have reported on the high-speed deformation properties and impact energy absorption of high-strength thin steel sheets, and in that article it was reported that the dynamic strength in the high strain rate range of about $10^3$ (l/s) is drastically increased in comparison to the static strength in the low strain rate of $10^{-3}$ (l/s), that the strain rate dependence for deformation resistance varies based on the strengthening mechanism for the material, and that TRIP (transformation induced plasticity) steel sheets and DP (ferrite/martensite dual phase) steel sheets possess both excellent formability and impact absorption properties compared to other high strength steel sheets.

Furthermore, Japanese Unexamined Patent Publication No. 7-18372, which provides retained austenite-containing high strength steel sheets with excellent impact resistance and a method for their production, discloses a solution for impact absorption simply by increasing the yield stress brought about by a higher deformation rate; however, it has not been demonstrated what other aspects of the retained austenite should be controlled, apart from the amount of retained austenite, in order to improve impact absorption.

Thus, although understanding continues to improve with regard to the dynamic deformation properties of member constituent materials affecting absorption of impact energy in automobile collisions, it is still not fully understood what properties should be maximized to obtain steel materials for automotive members with more excellent impact energy absorption properties, and on what criteria the selection of materials should be based. Steel materials for automotive members are formed into the required part shapes by press molding and, after usually undergoing painting and baking, are then incorporated into automobiles and subjected to actual instances of impact. However, it is still not clear what steel-strengthening mechanisms are suitable for improving the impact energy absorption of steel materials against collisions subsequent to such pre-deformation and baking treatment.

DISCLOSURE OF THE INVENTION

It is an object of the present invention to provide high-strength steel sheets with high impact energy absorption properties as steel materials for shaping and working into such parts as front side members which absorb impact energy upon collision, as well as a method for their production. First, the high-strength steel sheets exhibiting high impact energy absorption properties according to the present invention include:

(1) high-strength steel sheets with high flow stress during dynamic deformation, characterized in that the microstructure of the steel sheets in their final form is a composite microstructure of a mixture of ferrite and/or bainite, either of which is the dominant phase, and a third phase including retained austenite at a volume fraction between 3% and 50%, wherein the average value σdyn (MPa) of the flow stress in the range of 3~10% of equivalent strain when deformed in a strain rate range of $5\times10^2$~$5\times10^3$ (l/s) after pre-deformation of greater than 0% and less than or equal to 10% of equivalent strain, satisfies the inequality: $\sigma dyn \geqq 0.766\times TS+250$ as expressed in terms of the maximum stress TS (MPa) in the static tensile test as measured in a strain rate range of $5\times10^{-4}$~$5\times10^{-3}$ (l/s) without pre-deformation, and the work hardening coefficient between 1% and 5% of strain is at least 0.080; and (2) high-strength steel sheets with high flow stress during dynamic deformation according to (1) above, wherein the value of the work hardening coefficient between 1% and 5% of strain x yield strength is at least 40.

They further include:

(3) high-strength steel sheets with high flow stress during dynamic deformation, where the microstructure of the steel sheets in their final form is a composite microstructure of a mixture of ferrite and/or bainite, either of which is the dominant phase, and a third phase including retained austenite at a volume fraction between 3% and 50%, wherein the average value σdyn (MPa) of the flow stress in the range of 3~10% of equivalent strain when deformed in a strain rate range of $5\times10^2$~$5\times10^3$ (l/s) after pre-deformation of greater than 0% and less than or equal to 10% of equivalent strain, satisfies the inequality: $\sigma dyn \geqq 0.766\times TS+250$ as expressed in terms of the maximum stress TS (MPa) in the static tensile test as measured at a strain rate range of $5\times10^{-4}$~$5\times$ 10–3 (l/s) without pre-deformation, the value (M) determined by the solid solution [C] in the retained austenite and the average Mn equivalents of the steel {Mn eq=Mn+(Ni+Cr+Cu+Mo)/2}, defined by the equation M=678–428×[C]–33 Mn eq is at least 70 and no greater than 250, the difference between the retained austenite volume fraction without pre-deformation and the retained austenite volume fraction after applying a pre-deformation of 5% of equivalent strain is at least 30% of the retained austenite volume fraction without pre-deformation, the work hardening coefficient between 1% and 5% of strain is at least 0.080, the mean grain diameter of the retained austenite is no greater than 5 μm; the ratio of the mean grain diameter of the retained austenite and the mean grain diameter of the ferrite or bainite in the dominant phase is no greater than 0.6 while the average grain diameter of the dominant phase is no greater than 10 μm and preferably no greater than 6 μm; the volume of the martensite is 3~30% while the mean grain diameter of the martensite is no greater than 10 μm and preferably no greater than 5 μm, the volume fraction of the ferrite is at least 40%, the yield ratio is no greater than 85%, and the value of the tensile strength×total elongation is at least 20,000.

(4) The high-strength steel sheets of the present invention are also high-strength steel sheets containing, in terms of weight percentage, C at from 0.03% to 0.3%, either or both Si and Al at a total of from 0.5% to 3.0% and if necessary one or more from among Mn, Ni, Cr, Cu and Mo at a total of from 0.5% to 3.5%, with the remainder Fe as the primary component, or they are high-strength steel sheets with high flow stress during dynamic deformation obtained by further addition, if necessary, to the aforementioned high-strength steel sheets, or one or more from among Nb, Ti, V, P. B, Ca and REM, with one or more from among Nb, Ti and V at a total of no greater than 0.3%, P at no greater than 0.3%, B at no greater than 0.01%, Ca at from 0.0005% to 0.01% and REM at from 0.005% to 0.05%, with the remainder Fe as the primary component.

(5) The method for producing high-strength hot-rolled steel sheets with high flow stress during dynamic deformation according to the present invention, which are high-strength hot-rolled steel sheets with high flow stress during dynamic deformation where the microstructure of the hot-rolled steel sheets is a composite microstructure of a mixture of ferrite and/or bainite, either of which is the dominant phase, and a third phase including retained austenite of a volume fraction between 3% and 50%, wherein the average value σdyn (MPa) of the flow stress in the range of 3~10% of equivalent strain when deformed in a strain rate range of $5\times10^2\times10^3$ (1/s) after pre-deformation of greater than 0% and less than or equal to 10% of equivalent strain, satisfies the inequality: σdyn≧0.766×TS+250 as expressed in terms of the maximum stress TS (MPa) in the static tensile test as measured in a strain rate range of $5\times10^{-4}$~$5\times10^{-3}$ (1/s) without pre-deformation, and the work hardening coefficient between 1% and 5% of strain is at least 0.080, is characterized in that a continuous cast slab having the component composition of (4) above is fed directly from casting to a hot rolling step, or is hot rolled after reheating, the hot rolling is completed at a finishing temperature of $Ar_3$−50° C. to $Ar_3$+120° C., and after cooling at an average cooling rate of 5° C./sec in a cooling process following the hot rolling, the hot-rolled strip is coiled at a temperature of no greater than 500° C.

(6) The method of producing high-strength hot-rolled steel sheets with high flow stress during dynamic deformation is also that described in (5) above, wherein at the finishing temperature for hot-rolling in a range of $Ar_3$−50° C. to $Ar_3$+120° C., the hot rolling is carried out so that the metallurgy parameter: A satisfies inequalities (1) and (2) below, the subsequent average cooling rate in the run-out table is at least 5° C./sec, and the coiling is accomplished so that the relationship between the above-mentioned metallurgy parameter: A and the coiling temperature (CT) satisfies inequality (3) below.

$$9 \leqq \log A \leqq 18 \quad (1)$$

$$\Delta T \geqq 21\times\log A - 178 \quad (2)$$

$$CT \leqq 6\times\log A + 312 \quad (3)$$

(7) The method for producing high-strength cold-rolled steel sheets with high flow stress during dynamic deformation according to the present invention, which are high-strength cold-rolled steel sheets with flow stress during high dynamic deformation where the microstructure of the finally obtained cold-rolled steel sheets is a composite microstructure of a mixture of ferrite and/or bainite, either of which is the dominant phase, and a third phase including retained austenite at a volume fraction between 3% and 50%, wherein the average value σdyn (MPa) of the flow stress in the range of 3~10% of equivalent strain when deformed in a strain rate range of $5\times10^2$~$5\times10^3$ (1/s) after pre-deformation of greater than 0% and less than or equal to 10% of equivalent strain, satisfies the inequality: σdyn≧0.766×TS+250 as expressed in terms of the maximum stress TS (MPa) in the static tensile test as measured in a strain rate range of $5\times10^{-4}$~$5\times10^{-3}$ (1/s) without pre-deformation, and the work hardening coefficient between 1% and 5% of strain is at least 0.080, is also characterized in that a continuous cast slab having the component composition of (4) above is fed directly from casting to a hot rolling step, or is hot rolled after reheating, the coiled hot-rolled steel sheet after hot rolling is subjected to acid pickling and then cold-rolled, and during annealing in a continuous annealing step for preparation of the final product, annealing for 10 seconds to 3 minutes at a temperature of from $0.1\times(Ac_3-Ac_1)+Ac_1$° C. to $Ac_3$+50° C. is followed by cooling to a primary cooling stop temperature in the range of 550~700° C. at a primary cooling rate of 1~10° C./sec and then by cooling to a secondary cooling stop temperature in the range of 150~450° C. at a secondary cooling rate of 10~200° C./sec, after which the temperature is held in a range of 150~500° C. for 15 seconds to 20 minutes prior to cooling to room temperature, and further in that the specific post-annealing cooling conditions are such that annealing for 10 seconds to 3 minutes at a temperature of from $0.1\times(Ac_3-Ac_1)+Ac_1$° C. to $Ac_3$+50° C. is followed by cooling to a secondary cooling start temperature Tq in the range of 550~720° C. at the primary cooling rate of 1~10° C./sec and then by cooling to a secondary cooling stop temperature Te in the range from the temperature: Tem−100° C. determined by the steel component and annealing temperature To, to Tem at the secondary cooling rate of 10~200° C./sec, after which the temperature Toa is held in a range of Te−50° C. to 500° C. for 15 seconds to 20 minutes prior to cooling to room temperature.

BEST MODE FOR CARRYING OUT THE INVENTION

Collision impact absorbing members such as front side members in automobiles and the like are produced by subjecting steel sheets toga bending or press forming step. After being worked in this manner they are usually subjected to impact by automobile collision following painting and baking. The steel sheets, therefore, are required to exhibit high impact energy absorption properties after their working into members, painting and baking.

As a result of years of research on high-strength steel sheets as impact absorbing members satisfying the above-mentioned demands, the present inventors have found that inclusion of appropriate amounts of retained austenite in steel sheets for such shape-formed members is an effective means for obtaining high-strength steel sheets which exhibit excellent impact absorption properties. Specifically, it has been found that high flow stress during dynamic deformation is exhibited when the ideal microstructure is a composite structure including ferrite and/or bainite which are readily solid-solution strengthened by various substitutional elements, either of which as the dominant phase, and a third phase containing a 3~50% volume fraction of retained austenite which is transformed into hard martensite during deformation, while it has further been found that high-strength steel sheets with high flow stress during dynamic deformation can also be obtained with a composite structure wherein martensite is present in the third phase of the initial microstructure, provided that specific conditions are satisfied.

As a result of further experimentation and study based on these findings, the present inventors then discovered that the amount of pre-deformation corresponding to shape forming of impact absorbing members such as front side members sometimes reaches a maximum of over 20% depending on the section, but that the majority of the sections undergo deformation of greater than 0% and less than or equal to 10% with equivalent strain. Thus, upon determining the effect of the pre-deformation within that range, it is possible to estimate the behavior of the member as a whole after the pre-deformation. Consequently, according to the present invention, deformation of greater than 0% and less than or equal to 10% of equivalent strain was selected as the amount of pre-deformation to be applied to members during their working.

Figure 1:
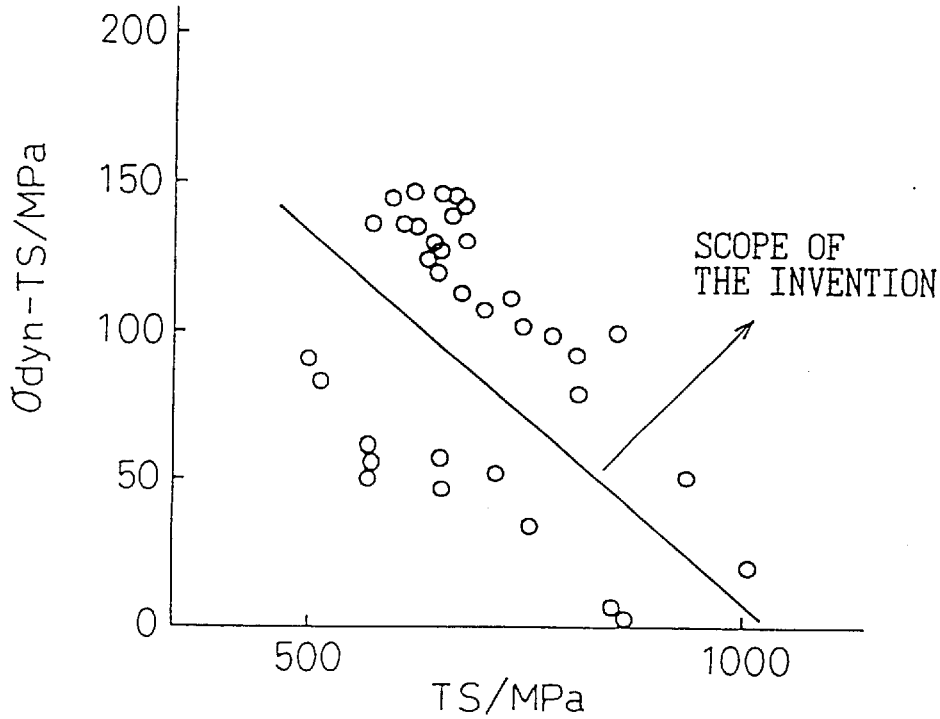
FIG. 1 is a graph showing the relationship between TS and the difference between the average value σdyn of the flow stress in the range of 3~10% of equivalent strain when deformed in a strain rate range of $5\times10^2$~$5\times10^3$ (1/s), and TS, as an indicator of the collision impact energy absorption property according to the invention.

FIG. 1 is a graph showing the relationship between the average value σdyn of the flow stress in the range of 3~10% of equivalent strain when deformed in a strain rate range of $5\times10^{2}$~$5\times10^{3}$ (l/s), and the static material strength TS (i.e., the maximum stress TS (MPa) in the static tensile test as measured in a strain rate range of $5\times10^{-4}5\times10^{-3}$ (l/s)), as an indicator of the collision impact energy absorption property according to the invention.

Impact absorbing members such as front side members have a hat-shaped cross-section, and as a result of analysis of deformation of such members upon being crushed by high-speed collision, the present inventors have found that despite deformation proceeding up to a high maximum strain of over 40%, at least 70% of the total absorption energy is absorbed in a strain range of 10% or lower in a high-speed stress-strain diagram. Therefore, the flow stress during dynamic deformation with high-speed deformation at 10% or lower was used as the index of the high-speed collision energy absorption property. In particular, since the amount of strain in the range of 3~10% is most important, the index used for the impact energy absorption property was the average stress σdyn in the range of 3~10% of equivalent strain when deformed in a strain rate range of $5\times10^{2}$~$5\times10^{3}$ (l/s) high-speed tensile deformation.

The average stress σdyn of 3~10% upon high-speed deformation generally increases with increasing static tensile strength {maximum stress: TS (MPa) in a static tensile test measured in a stress rate range of $5\times10^{-4}$~$5\times10^{-3}$ (l/s)} of the steel material without pre-deformation or baking treatment. Consequently, increasing the static tensile strength (synonymous with the static material strength) of the steel material directly contributes to improved impact energy absorption property of the member. However, increased strength of the steel material results in poorer formability into members, making it difficult to obtain members with the necessary shapes. Consequently, steel materials having a high σdyn with the same tensile strength (TS) are preferred. It was found that, based on this relationship, steel materials wherein the average value σdyn (MPa) of the flow stress in the range of 3~10% of equivalent strain, when deformed in a strain rate range of $5\times10^{2}$~$5\times10^{3}$ (l/s) after pre-deformation at greater than 0% and less than or equal to 10%, satisfy the inequality $\sigma dyn-TS \geqq -0.234\times TS+250$ as expressed in terms of the maximum stress TS (MPa) in the static tensile test as measured in a strain rate range of $5\times10^{-4}$~$5\times10^{-3}$ (l/s) without pre-deformation, have higher impact energy absorption properties as actual members compared to other steel materials, and that the impact energy absorption property is improved without increasing the overall weight of the member, making it possible to provide high-strength steel sheets with high flow stress during dynamic deformation. Incidentally, since the above relational inequality $\sigma dyn-TS \geqq -0.234\times TS+250$ is equivalent to $\sigma dyn \geqq 0.766\times TS+250$, the inequality $\sigma dyn \geqq 0.766\times TS+250$ will be used in the explanation which follows.

Figure 2:
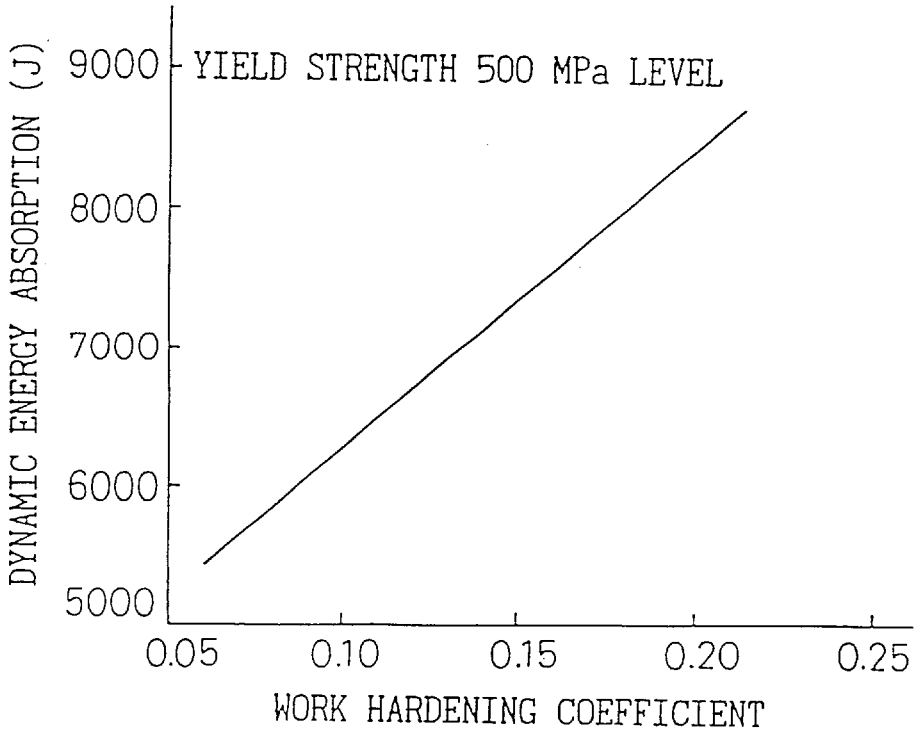
FIG. 2 is a graph showing the relationship between the work hardening coefficient and dynamic energy absorption (J) for a steel sheet between 1% and 5% of strain.
Figure 3:
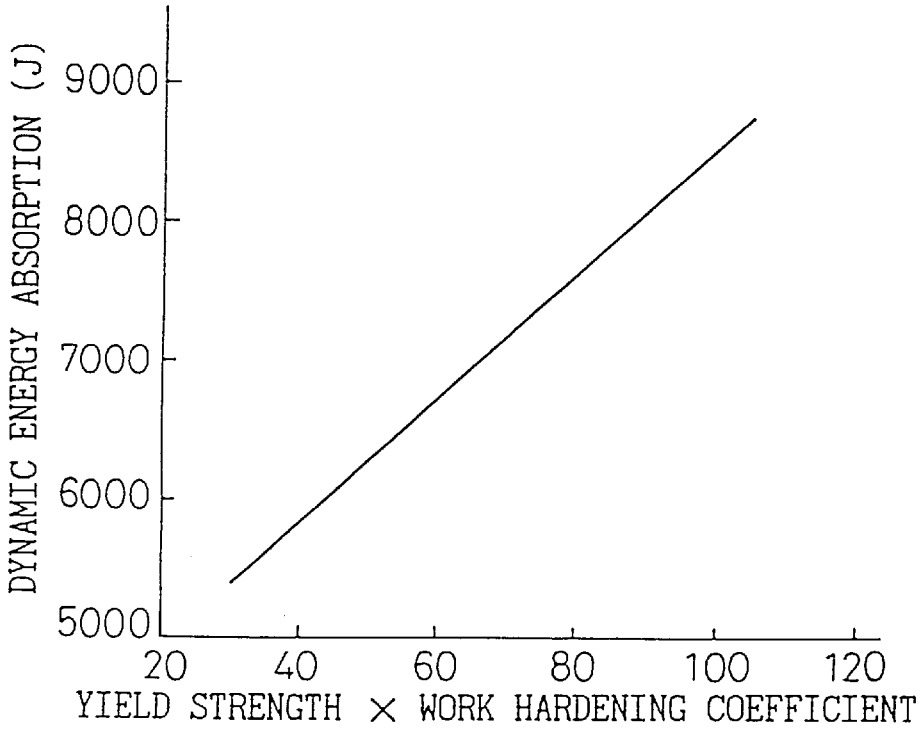
FIG. 3 is a graph showing the relationship between the work hardening coefficient at yield strength×1~5% of strain and the dynamic energy absorption (J), for a steel sheet.

The present inventors have also discovered that for improved anti-collision safety, an increased work hardening during pre-working as represented by the work hardening coefficient between 1% and 5% of strain is necessary for greater initial deformation resistance at the initial point of collision, as well as for higher work hardening during collision deformation by the presence of martensite transformed during pre-deformation, and for an increased σdyn. That is to say, the anti-collision safety may be increased by controlling the microstructure of the steel material as explained above so that, as shown in FIG. 2 and FIG. 3, the work hardening coefficient of the steel is at least 0.080, and preferably at least 0.108, and so that the work hardening coefficient between 1% and 5% of at yield strain×yield strength is at least 40, and preferably at least 54. By viewing the relationship between the dynamic energy absorption, which is an indicator of the anti-collision safety of automobile members, and the work hardening coefficient and yield strength×work hardening coefficient of the steel sheets, it can be seen that the dynamic energy absorption improves as the values increase, suggesting that a proper evaluation can be made based on the work hardening coefficient of the steel sheets as an indicator of anti-collision safety of automobile members, so long as the yield strength level is the same, or based on the yield strength×work hardening coefficient if the yield strength differs.

Figure 4A:
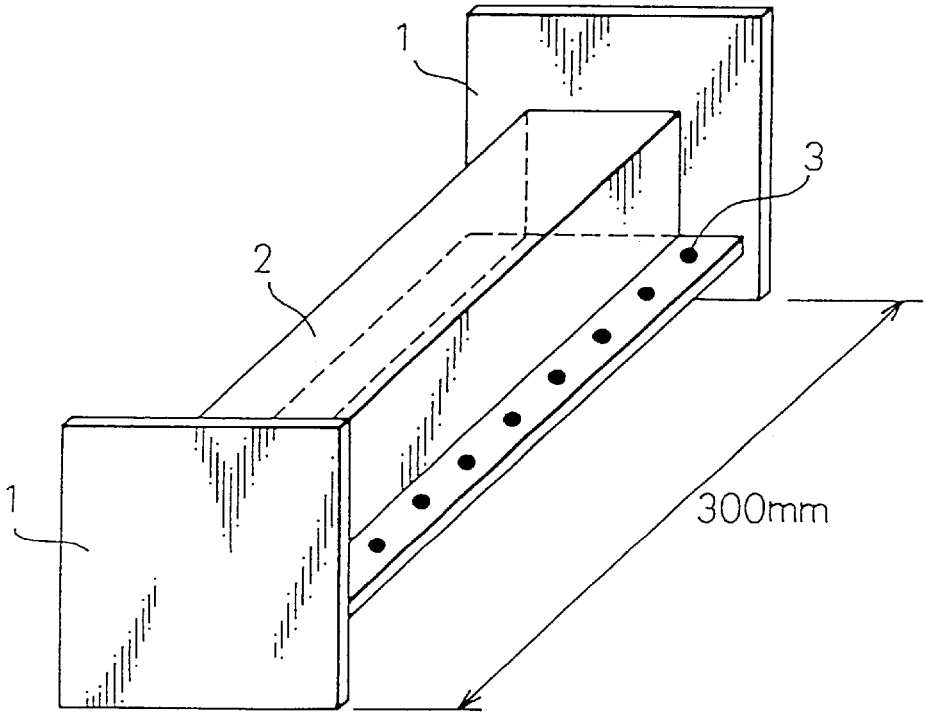
FIG. 4*a* is a perspective view of a part (hat-shaped model) used for an impact crush test for measurement of dynamic energy absorption in FIG. 3.
Figure 4B:
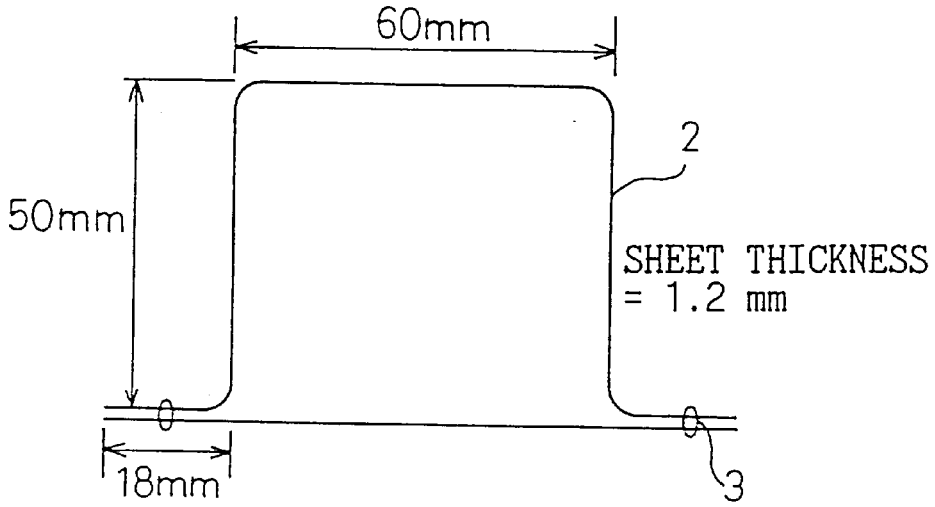
FIG. 4*b* is a cross-sectional view of the test piece used in FIG. 4*a*.
Figure 4C:
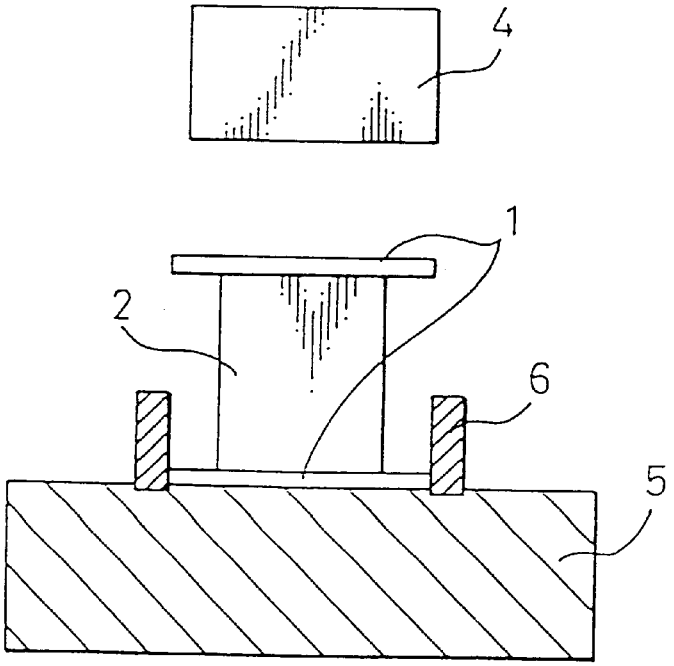
FIG. 4*c* is a schematic view of the impact crush test method.

The dynamic energy absorption was determined in the following manner by the impact crush test method as shown in FIG. 4*a*, FIG. 4*b* and FIG. 4*c*. A steel sheet is shaped into a test piece (corner R=5 mm) such as shown in FIG. 4*b*, and spot welded 3 with a 35 mm pitch at a current of 0.9 times the expulsion current using an electrode with a tip radius of 5.5 mm, to make a part (hat-shaped model) with the test piece 2 set between two worktops 1 as shown in FIG. 4*a*, and then, after a baking and painting treatment at 170° C. for 20 minutes, a weight 4 of approximately 150 Kg, as shown in FIG. 4*c*, is dropped from a height of about 10 m, the part placed on a frame 5 provided with a shock absorber 6 is crushed in the lengthwise direction, and the deformation work at displacement =0~150 mm is calculated from the area of the corresponding load displacement diagram to determine the dynamic energy absorption.

The work hardening coefficient of the steel sheet at a 1~5% strain and the work hardening coefficient between 1% and 5% of at yield strain×yield strength were calculated in the following manner. Specifically, the steel sheet was worked into a JIS-5 test piece (gauge length: 50 mm, parallel part width: 25 mm) and a tensile test at a strain rate of 0.001/sec was carried out to determine the yield strength and work hardening coefficient (n value for strain of 1~5%).

The microstructure of a steel sheets according to the invention will now be described.

When a suitable amount of retained austenite is present in steel sheets, the strain undergone during deformation (shaping) results in its transformation into extremely hard martensite, and thus has the effect of increasing the work hardening coefficient and improving the formability by controlling necking. A suitable amount of retained austenite is preferably 3% to 50%. Specifically, if the volume fraction of the retained austenite is less than 3%, the shaped member cannot exhibit its excellent work hardening property upon undergoing collision deformation, the deformation load remains at a low level resulting in a low deformation work and therefore the dynamic energy absorption is lower making it impossible to achieve improved anti-collision safety, and the anti-necking effect is also insufficient, making it impossible to obtain a high tensile strength×total elongation. On the other hand, if the volume fraction of the retained austenite is greater than 50%, working-induced martensite transformation occurs in a concatenated fashion with only slight shape working strain, and no improvement in the tensile strength×total elongation can be expected since the hollow extension ratio instead deteriorates as a result of notable hardening which occurs during punching, while even if shaping of the member is possible, the shaped member cannot exhibit its excellent work hardening property upon undergoing collision deformation; the above-mentioned range for the retained austenite content is determined from this viewpoint.

In addition to the aforementioned condition of a retained austenite volume fraction of 3~50%, another desired condition is that the mean grain diameter of the retained austenite should be no greater than 5 μm, and preferably no greater than 3 μm. Even if the retained austenite volume fraction of 3~50% is satisfied, a mean grain diameter of greater than 5 μm is not preferred because this will prevent fine dispersion of the retained austenite in the steel, resulting in only local inhibition of the improving effect by the characteristics of the retained austenite. Furthermore, it was shown that excellent anti-collision safety and formability are exhibited when the microstructure is such that the ratio of the aforementioned mean grain diameter of the retained austenite to the average grain diameter of the ferrite or bainite of the dominant phase is no greater than 0.6, and the average grain diameter of the dominant phase is no greater than 10 μm, and preferably no greater than 6 μm.

The present inventors have further discovered that the average stress: σdyn at the aforementioned range of 3~10% of equivalent strain with the same level of tensile strength (TS: MPa), varies according to the solid solution carbon content: [C] in the retained austenite contained in the steel sheet prior to its working into a member (wt %), and the average Mn equivalents of the steel material (Mn eq) as expressed by Mn eq=Mn+(Ni+Cr+Cu+Mo)/2. The carbon concentration in the retained austenite can be experimentally determined by X-ray diffraction and Mossbauer spectrometry, and for example, it can be calculated by the method indicated in the Journal of The Iron and Steel Institute, 206(1968), p60, utilizing the integrated reflection intensity of the (200) plane, (211) plane of the ferrite and the (200) plane, (220) plane and (311) plane of the austenite, with X-ray diffraction using Mo Kα rays. Based on experimental results obtained by the present inventors, it was also found that when the value: M, as defined by M=678~428×[C]−33×Mn eq, is at least 70 and no greater than 250, by calculation using the solid solution carbon content [C] in the retained austenite and Mn eq determined from the substitutional alloy elements added to the steel material, both obtained in the manner described earlier, and the difference between the volume fraction of the retained austenite without pre-deformation ($V_0$) and the volume fraction of the retained austenite after applying pre-deformation of 5% of *equivalent strain ($V_5$): $\{(V_0)-(V_5)\}$ is at least 30% of a volume fraction of the retained austenite without pre-deformation, then a large σdyn is exhibited at the same static tensile strength (TS). In such cases, since the effect of an increased strength by transformation of the retained austenite during deformation is substantially limited to the low strain region when M>250, virtually all of the retained austenite is wasted during pre-deformation of the member and can no longer provide an increase in σdyn for high-speed deformation; the upper. limit for M was therefore set to be 250. Furthermore, when M is less than 70, transformation of the retained austenite progresses during deformation, but transformation fails to progress to a sufficient degree in the low strain region, and therefore the average stress σdyn in the range of 3~10% of equivalent strain is kept low, thus failing to satisfy the relationship σdyn≧0.766×TS+250 with respect to the static tensile strength TS; the lower limit for M was therefore set to be 70.

In regard to the location of the retained austenite, since soft ferrite usually receives the strain of deformation, the retained γ (austenite) which is not adjacent to ferrite tends to escape the strain and thus fails to be transformed into martensite with deformation of about 1~5%; because of this lessened effect, it is preferred for the retained austenite to be adjacent to the ferrite. For this reason, the volume fraction of the ferrite is desired to be at least 40%, and preferably at least 60%, and the mean grain diameter (corresponding to the mean circle-equivalent diameter) is desired to be no greater than 10 μm, and preferably no greater than 6 μm. As explained above, since ferrite is the softest substance in the constituent composition, it is an important factor in determining the work hardening coefficient between 1% and 5% of strain×yield strength and the yield ratio. The volume fraction should preferably be within the prescribed values. In addition, increasing the volume fraction and fineness of the ferrite is effective for raising the carbon concentration of the untransformed austenite and finely dispersing it, thus resulting in greater fineness of the martensite produced from the untransformed austenite as well as of the remaining composition, and increasing the volume fraction and fineness of the retained austenite, which will contribute to improved anti-collision safety effects and formability.

The martensite is at a volume fraction of 3~30% and it is desired to have a mean grain diameter (corresponding to the mean circle-equivalent diameter) of no greater than 10 μm, and preferably no greater than 6 μm. The martensite primarily creates mobile transfer in the surrounding ferrite, contributing to a lower yield rate and improved work hardening coefficient, and therefore results in further improvement in the anti-collision safety effect and formability by satisfying the designated values mentioned above, allowing a more desired level of properties to be achieved, specifically a work hardening coefficient between 1% and 5% of strain more than 54×yield strength more than 75%. The relationship between the volume fraction and the mean grain diameter of the martensite is such that even with a low volume fraction and a large mean grain diameter the effect is limited to local influence, making it impossible to satisfy the aforementioned properties. In regard to the location of the martensite, when the martensite is not adjacent to ferrite, the influence of the mobile transfer, etc. of the martensite barely reaches the ferrite, thus lessening its effect. Consequently, the martensite is preferred to be adjacent to the ferrite.

The chemical components and their content restrictions in high-strength steel sheets which exhibit the aforementioned microstructure and various characteristics will now be explained. The high-strength steel sheets used according to the invention are high-strength steel sheets containing, in terms of weight percentage, C at from 0.03% to 0.3%, either or both Si and Al at a total of from 0.5% to 3.0% and if necessary one or more from among Mn, Ni, Cr, Cu and Mo at a total of from 0.5% to 3.5%, with the remainder Fe as the primary component, or they are high-strength steel sheets with high dynamic deformation resistance obtained by further addition if necessary to the aforementioned high-strength steel sheets, one or more from among Nb, Ti, V, P, B, Ca and REM, with one or more from among Nb, Ti and V at a total of no greater than 0.3%, P at no greater than 0.3%, B at no greater than 0.01%, Ca at from 0.0005% to 0.01% and REM at from 0.005% to 0.05%, with the remainder Fe as the primary component. These chemical components and their contents (all in weight percentages) will now be discussed.

C: C is the most inexpensive element for stabilizing austenite at room temperature and thus contributing to the necessary stabilization of austenite for its retention, and therefore it may be considered the most essential element according to the invention. The average carbon content in the steel sheet not only affects the retained austenite volume fraction which can be ensured at room temperature but, by increasing the concentration in the untransformed austenite during the working at the heat treatment of production, it is possible to improve the stability of the retained austenite for working. If the C content is less than 0.03%, however,.a final retained austenite volume fraction of at least 3% cannot be ensured, and therefore 0.03% is the lower limit. On the other hand, as the average C content of the steel sheet increases the ensurable retained austenite volume fraction also increases, allowing the stability of the retained austenite to be ensured by ensuring the retained austenite volume fraction. Nevertheless, if the C content of the steel sheet is too great, not only does the strength of the steel sheet exceed the necessary level thus impairing the formability for press working and the like, but the dynamic stress increase is also inhibited with respect to the static strength increase, while the preduced weldability limits the use of the steel sheet as a member; the upper limit for the C content was therefore determined to be 0.3%.

Si, Al: Si and Al are both ferrite-stabilizing elements, and they serve to increase the ferrite volume fraction for improved workability of the steel sheet. In addition, Si and Al both inhibit production of cementite, allowing C to be effectively concentrated in the austenite, and therefore addition of these elements is essential for retention of austenite at a suitable volume fraction at room temperature. Other elements whose addition has this effect of suppressing production of cementite include, in addition to Si and Al, also P, Cu, Cr, Mo, etc. A similar effect can be expected by appropriate addition of these elements as well. However, if the total amount of either or both Si and Al is less than 0.5%, the cementite production-inhibiting effect will be insufficient, thus wasting as carbides most of the added C which is the most effective component for stabilizing the austenite, and this will either render it impossible to ensure the retained austenite volume fraction required for the invention, or else the production conditions necessary for ensuring the retained austenite will fail to satisfy the conditions for volume production processes; the lower limit was therefore determined to be 0.5%. Also, if the total of either or both Si and Al exceeds 3.0%, the primary phase of ferrite or bainite will tend to become hardened and brittle, not only inhibiting increased deformation resistance from the increased strain rate, but also leading to lower workability and lower toughness of the steel sheet, increased cost of the steel sheet, and much poorer surface treatment characteristics for chemical treatment and the like; the upper limit was therefore determined to be 3.0%. In cases where particularly superior surface properties are demanded, Si scaling may be avoided by having Si≦0.1% or conversely Si scaling may be generated over the entire surface, to be rendered less conspicuous, by having Si≧1.0%.

Mn, Ni, Cr, Cu, Mo: Mn, Ni, Cr, Cu and Mo are all austenite-stabilizing elements, and are effective elements for stabilizing austenite at room temperature. In particular, when the C content is restricted from the standpoint of weldability, the addition of appropriate amounts of these austenite-stabilizing elements can effectively promote retention of austenite. These elements also have an effect of inhibiting production of cementite, although to a lesser degree than Al and Si, and act as aids for concentration of C in the austenite. Furthermore, these elements cause solid-solution strengthening of the ferrite and bainite matrix together with Al and Si, thus also acting to increase the flow stress during dynamicdeformation at high speeds. However, if the total content of any or more than one of these elements is less than 0.5%, it will become impossible to ensure the necessary retained austenite, while the strength of the steel material will be lowered, thus impeding efforts to achieve effective vehicle weight reduction; the lower limit was therefore determined to be 0.5%. On the other hand, if the total amount of those elements exceeds 3.5%, the primary phase of ferrite or bainite will tend to be hardened, not only inhibiting increased deformation resistance from the increased strain rate, but also leading to lower workability and lower toughness of the steel sheet, and increased cost of the steel material; the upper limit was therefore determined to be 3.5%.

Nb, Ti or V which are added as necessary can promote higher strength of the steel sheet by forming carbides, nitrides or carbonitrides, but if their total exceeds 0.3%, excess amounts of the nitrides, carbides or carbonitrides will precipitate in the crystal grains or at the grain boundaries of the ferrite or bainite primary phase, becoming a source of mobile transfer during high-speed deformation and making it impossible to achieve high flow stress during dynamic deformation. In addition, production of carbides inhibits concentration of C in the retained austenite which is the most essential aspect of the present invention, thus wasting the C content; the upper limit was therefore determined to be 0.3%.

B or P are also added as necessary. B is effective for strengthening of the grain boundaries and high strengthening of the steel sheet, but if it is added at greater than 0.01% its effect will be saturated and the steel sheet will be strengthened to a greater degree than necessary, thus inhibiting increased deformation resistance against high-speed deformation and lowering its workability into parts; the upper limit was therefore determined to be 0.01%. Also, P is effective for ensuring high strength and retained austenite for the steel sheet, but if it is added at greater than 0.2% the cost of the steel sheet will tend to increase, while the deformation resistance of the dominant phase of ferrite or bainite will be increased to a higher degree than necessary, thus inhibiting increased deformation resistance against high-speed deformation and resulting in poorer season cracking resistance and poorer fatigue characteristics and tenacity; the upper limit was therefore determined to be 0.2%. From the standpoint of preventing reduction in the secondary workability, tenacity, spot weldability and recyclability, the upper limit is more desirably 0.02%. Also, with regard to the S content as an unavoidable impurity, the upper limit is more desirably 0.01% from the standpoint of preventing reduction in formability (especially the hollow extension ratio) and spot weldability due to sulfide-based inclusions.

Ca is added to at least 0.0005% for improved formability (especially hollow extension ratio) by shape control (spheroidization) of sulfide-based inclusions, and its upper limit was determined to be 0.01% in consideration of effect saturation and the adverse effect due to increase in the aforementioned inclusions (reduced hollow extension ratio). In addition, since REM has a similar effect as Ca, its added content was also determined to be from 0.005% to 0.05%.

Production methods for obtaining high-strength steel sheets according to the invention will now be explained in detail, with respect to hot-rolled steel sheets and cold-rolled steel sheets.

As the production method for both high-strength hot-rolled steel sheets and cold-rolled steel sheets with high flow stress during dynamic deformation according to the invention, a continuous cast slab having the component composition described above is fed directly from casting to a hot rolling step, or is hot rolled after reheating. Continuous casting for thin gause strip and hot rolling by the continuous hot rolling techniques (endless rolling) may be applied for the hot rolling in addition to normal continuous casting, but in order to avoid a lower ferrite volume fraction and a coarser mean grain diameter of the thin steel sheet microstructure, the steel sheet thickness at the hot rolling approach side (the initial steel billet thickness) is preferred to be at least 25 mm. Also, the final pass rolling speed for the hot rolling is preferred to be at least 500 mpm and more preferably at least 600 mpm, in light of the problems described above.

In particular, the finishing temperature for the hot rolling during production of the high-strength hot-rolled a steel sheets is preferably in a temperature range of $Ar_3$−50° C. to $Ar_3$+120° C. as determined by the chemical components of the steel sheet. At lower than $Ar_3$−50° C., deformed ferrite is produced, with an inferior flow stress during dynamic deformation σdyn, 1~5% work hardening property and formability. At higher than $Ar_3$−120° C., the flow stress during dynamic deformation σdyn, the 1~5% work hardening property, etc. are inferior because of a coarser steel sheet microstructure, while it is also not preferred from the viewpoint of scale defects. The steel sheets which have been hot-rolled in the manner described above are subjected to a coiling step after being cooled on a run-out table. The average cooling rate here is at least 5° C./sec. The cooling rate is decided from the standpoint of ensuring the volume fraction of the retained austenite. The cooling method may be carried out at a constant cooling rate, or with a combination of different cooling rates which include a low cooling rate range during the procedure.

The hot-rolled steel sheets are then subjected to a, coiling step, where they are preferably coiled at a coiling temperature of 500° C. or below. A coiling temperature of higher than 500° C. will result in a lower retained austenite volume fraction. To obtain martensite, the coiling temperature is set to 350° C. or below. The aforementioned coiling conditions are for steel sheets to be directly provided as hot-rolled steel sheets after coiling, and these restricting conditions are unnecessary for cold-rolled steel sheets which have been further cold rolled and subjected to annealing, as such coiling may be carried out under common production conditions.

Figure 5:
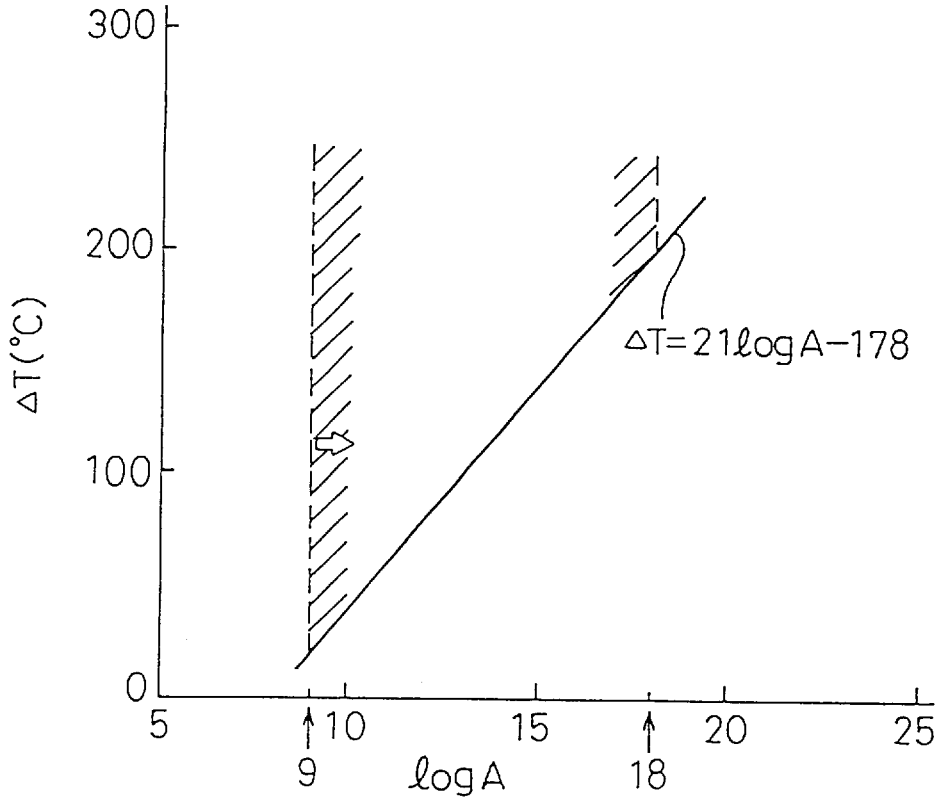
FIG. 5 is a graph showing the relationship between ΔT and the metallurgy parameter A for the hot-rolling step according to the invention.
Figure 6:
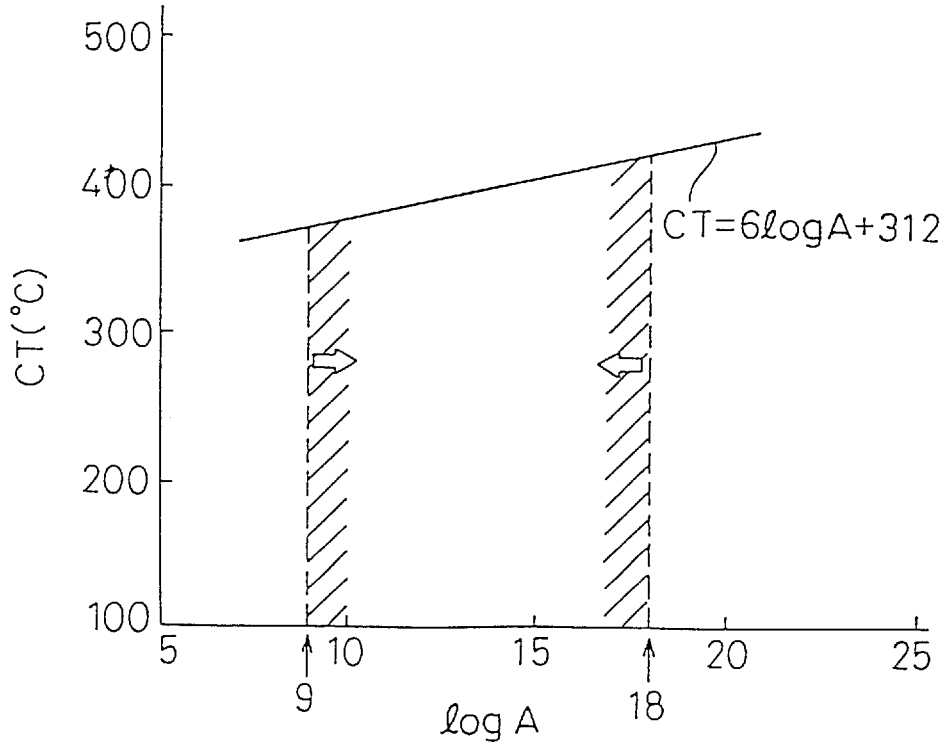
FIG. 6 is a graph showing the relationship between the coiling temperature and the metallurgy parameter A for the hot-rolling step according to the invention.

According to the invention, it was found particularly that a correlation exists between the finishing temperature in the hot-rolling step, the finishing approach temperature and the coiling temperature. That is, as shown in FIG. 5 and FIG. 6, specific conditions exist which are determined primarily by the finishing temperature, finishing approach temperature and the coiling temperature. In other words, the hot-rolling is carried out so that when the finishing temperature for hot rolling is in the range of $Ar_3$−50° C. to $Ar_3$+120° C., the metallurgy parameter: A satisfies inequalities (1) and (2). The above-mentioned metallurgy parameter: A may be expressed by the following equation.

$$A=\epsilon^*\times\exp\{(75282-42745\times C_{eq})/[1.978\times(FT+273)]\}$$

where

FT: finishing temperature (° C.)

Ceq: carbon equivalents=C+$Mn_{eq}$/6(%)

$Mn_{eq}$: manganese equivalents Mn+(Ni+Cr+Cu+Mo)/2 (%)

$\epsilon^*$: final pass strain rate ($s^{-1}$)

$\epsilon^* = (v/\sqrt{R\times h_1})\times(1/\sqrt{r})\times\ln\{1/(1-r)\}$ $h_1$: final pass approach sheet thickness $h_2$: final pass exit sheet thickness r: $(h_1-h_2)/h_1$ R: roll radius v: final pass exit speed ΔT: finishing temperature (finishing final pass exit temperature)−finishing approach temperature (finishing first pass approach temperature)

$Ar_3$: 901−325 C%+33 Si%−92 $Mn_{eq}$

Thereafter, the average cooling rate on the run-out table is 5° C./sec, and the coiling is preferably carried out under conditions such that the relationship between the metallurgy parameter: A and the coiling temperature (CT) satisfies inequality (3).

$$9 \leqq \log A \leqq 18 \quad (1)$$

$$\Delta T \geqq 21 \times \log A - 178 \quad (2)$$

$$CT \leqq 6 \times \log A + 312 \quad (3)$$

In inequality (1) above, a logA of less than 9 is unacceptable from the viewpoint of production of retained γ and fineness of the microstructure, while it will also result in inferior flow stress during dynamic deformation σdyn and 1~5% work hardening property. Also, if logA is to be greater than 18, massive equipment will be required to achieve it. If the condition of inequality (2) is not satisfied, the retained γ will be excessively stable, and therefore although transformation of the retained γ will proceed during deformation it will not occur to a sufficient degree in the low strain region, and will result in inferior flow stress during dynamic deformation σdyn and 1~5% work hardening property, etc. The lower limit for ΔT is more flexible with a lower logA as indicated by inequality (2). Also, the upper limit for ΔT is preferred to be 300° C. from the viewpoint of increasing size of facility, lower retained austenite volume fraction and coarseness of the microstructure. Furthermore, if the relationship with the coiling temperature in inequality (3) is not satisfied, there will be an adverse effect on ensuring the amount of retained γ, while the retained γ will be excessively stable even if retained γ can be obtained, and although transformation of the retained γ will proceed during deformation it will not occur to a sufficient degree in the low strain region, and will result in inferior flow stress during dynamic deformation σdyn and 1~5% work hardening property, etc. The lower limit for the coiling temperature (CT) is more flexible with a higher logA.

Incidentally, when the initial martensite volume fraction is greater than 3%, the CT may be higher than 350° C. However, it is preferred from CT to be higher than 250° C. in order to prevent overproduction of martensite.

Figure 7:
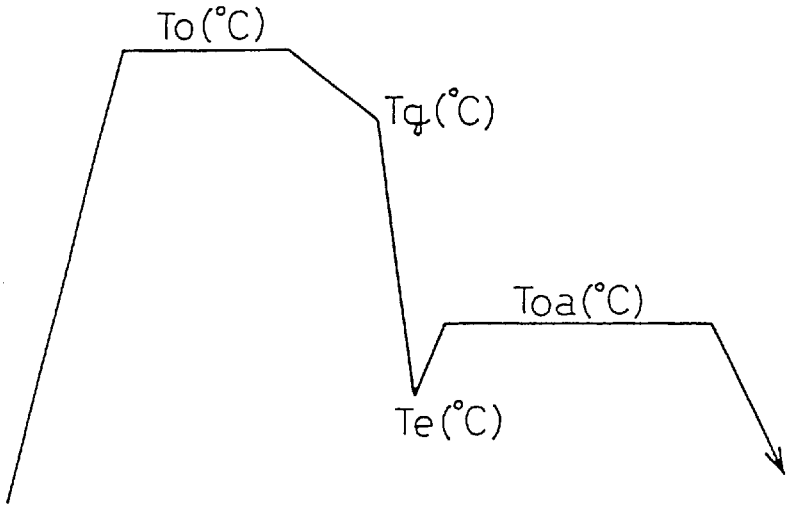
FIG. 7 is an illustration of the annealing cycle in a continuous annealing step according to the invention.

The cold-rolled steel sheets according to the invention are then subjected to the different steps following hot-rolling and coiling and are cold-rolled at a reduction ratio of 40% or greater, after which the ha cold-rolled steel sheets are subjected to annealing. The annealing is ideally continuous annealing through an annealing cycle such as shown in FIG. 7, and during the annealing of the continuous annealing step to prepare the final product, annealing for 10 seconds to 3 minutes at temperature To of from $0.1\times(Ac_3-Ac_1)+Ac_1$° C. to $Ac_3$+50° C. is followed by cooling to a primary cooling stop temperature Tq in the range of 550~720° C. at a primary cooling rate of 1~10° C./sec and then by cooling to a secondary cooling stop temperature Te at a secondary cooling rate of 10~200° C./sec, after which temperature Toa is held for 15 seconds to 20 minutes prior to cooling to room temperature. If the aforementioned annealing temperature To is less than $0.1\times(Ac_3-Ac_1)+Ac_1$° C. in terms of the $Ac_1$ and $Ac_3$ temperatures determined based on the chemical components of the steel sheets (see, for example, "Iron & Steel Material Science": W. C. Leslie, Maruzen, p.273), the amount of austenite obtained at the annealing temperature will be too low, making it impossible to leave stably retained austenite in the final steel sheets; the lower limit was therefore determined to be $0.1\times(Ac_3\times Ac_1)+Ac_1$° C. Also, since no improvement in characteristics of the steel sheets are achieved even if the annealing temperature exceeds $Ac_3$+50° C. and the cost merely increases, the upper limit for the annealing temperature was determined to be $Ac_3$ +50° C. The required annealing time at this temperature is a minimum of 10 seconds in order to ensure a uniform temperature and an appropriate amount of austenite for the steel sheets, but if the time exceeds 3 minutes the effect described above becomes saturated and costs will thus be increased.

Primary cooling is necessary for the purpose of promoting transformation of the austenite to ferrite and concentrating the C in the untransformed austenite to stabilize the austenite. If the cooling rate is less than 1° C./sec a longer production line will be necessary, and therefore from the standpoint of avoiding reduced productivity the lower limit is 1° C./sec. On the other hand, if the cooling rate exceeds 10° C./sec, ferrite transformation does not occur to a sufficient degree, and it becomes difficult to ensure the retained austenite in the final steel sheets; the upper limit was therefore determined to be 10° C./sec. If the primary cooling is carried out to lower than 550° C., pearlite is produced during the cooling, the austenite-stabilizing element C is wasted, and thus the final sufficient amount of retained austenite cannot be achieved. Also, if the cooling is carried out to no lower than 720° C., ferrite transformation does not proceed to a sufficient degree.

The rapid cooling of the subsequent secondary cooling must be carried out at a cooling rate of at least 10° C./sec so as not to cause pearlite transformation or precipitation of iron carbides during the cooling, but cooling carried out at greater than 200° C./sec will create a burden on the equipment. Also, if the cooling stop temperature in the secondary cooling is lower than 150° C., virtually all of the remaining austenite prior to cooling will be transformed into martensite, making it impossible to ensure the final necessary amount of retained austenite. Conversely, if the cooling stop temperature is higher than 450° C. the final flow stress during dynamic deformation σdyn will be lowered.

For room temperature stabilization of the austenite retained in the steel sheets, a portion thereof is preferably transformed to bainite to further increase the carbon concentration in the austenite. If the secondary cooling stop temperature is lower than the temperature maintained for bainite transformation, it is increased to the maintained temperature. The final characteristics of the steel sheets will not be impaired so long as this heating rate is from 5° C./sec to 50° C./sec. Conversely, if the secondary cooling stop temperature is higher than the bainite processing temperature, the final characteristics of the steel sheets will not be impaired even with forced cooling to the bainite processing temperature at a cooling rate of 5° C./sec to 200° C./sec and with direct conveyance to a heating zone preset to the desired temperature. On the other hand, since the sufficient amount of,retained austenite cannot be ensured in cases where the steel sheet is held at below 150° C. or held at above 500° C., the range for the holding temperature was determined to be 150° C. to 500° C. If the temperature is held at 150° C. to 500° C. for less than 15 seconds, the bainite transformation does not proceed to a sufficient degree, making it impossible to obtain the final necessary amount of retained austenite, while if it is held in that range for more than 20 minutes, precipitation of iron carbides or pearlite transformation will result after bainite transformation, resulting in waste of the carbon which is indispensable for production of the retained austenite and making it impossible to obtain the necessary amount of retained austenite; the holding time range was therefore determined to be from 15 seconds to 20 minutes. The holding at 150° C. to 500° C. in order to promote bainite transformation may be at a constant temperature throughout, or the temperature may be deliberately varied within this temperature range without impairing the characteristics of the final steel sheets.

Figure 8:
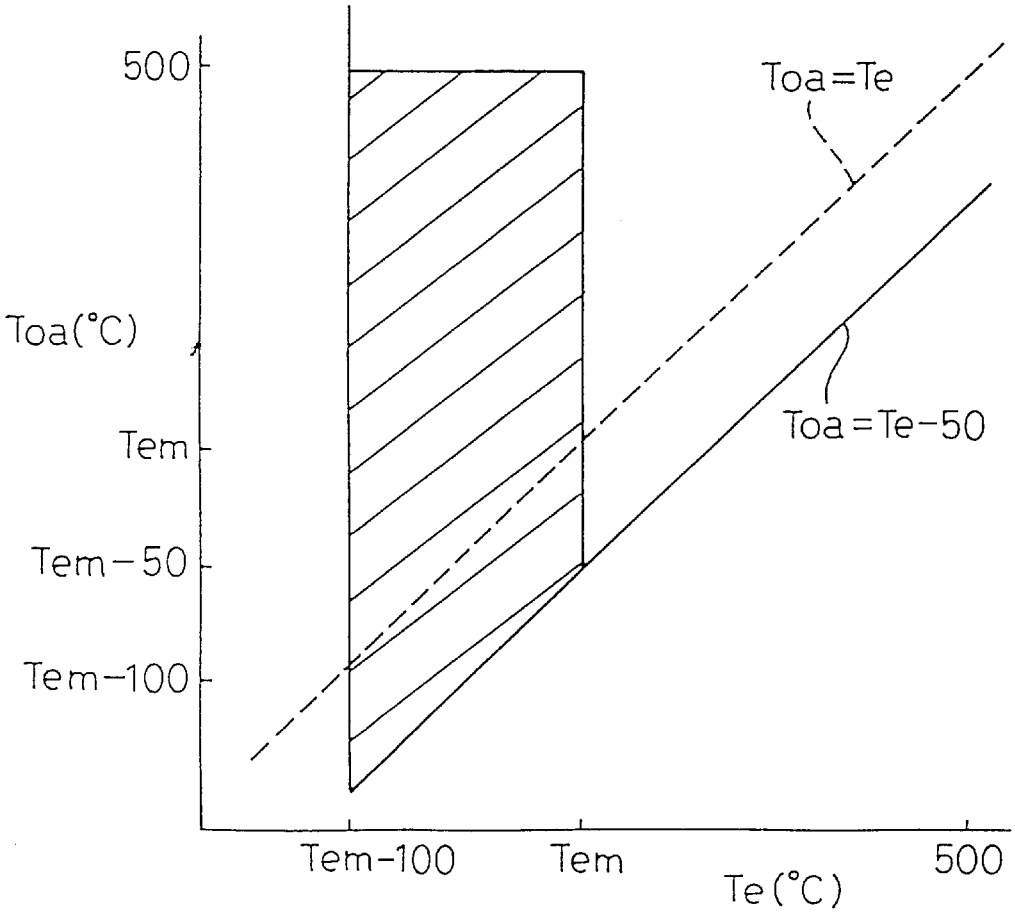
FIG. 8 is a graph showing the relationship between the secondary cooling stop temperature (Te) and the subsequent averaging temperature (Toa) in a continuous annealing step according to the invention.

As preferred cooling conditions after annealing according to the invention, annealing for 10 seconds to 3 minutes at a temperature of from $0.1\times(Ac_3-Ac_1)+Ac_1$° C. to $Ac_3+50$° C. is followed by cooling to a secondary cooling start temperature Tq in the range of 550~720° C. at the primary cooling rate of 1~10° C./sec and then by cooling to a secondary cooling stop temperature Te in the range from the temperature Tem−100° C. to Tem determined by the steel component and annealing temperature To at the secondary cooling rate of 10~200° C./sec, after which the temperature Toa is held in a range of Te−50° C. to 500° C. for 15 seconds to 20 minutes prior to cooling to room temperature. This is a method wherein the quenching end point temperature Te in a continuous annealing cycle as shown in FIG. 8, is represented as a function of the component and annealing temperature To, and annealing is carried out at below a given critical value, while the range of the averaging temperature Toa is defined by the relationship with the quenching end point temperature Te.

Here, Tem is the martensite transformation start temperature for the retained austenite at the quenching start point Tq. That is, Tem is defined by Tem=T1−T2, or the difference between the value excluding the effect of the carbon concentration in the austenite (T1) and the value indicating the effect of the carbon concentration (T2). Here, T1 is the temperature calculated from the solid solution element concentration excluding carbon, and T2 is the temperature calculated from the carbon concentration in the retained austenite at $Ac_1$ and $Ac_3$ determined by the components of the steel sheets and Tq determined by the annealing temperature To. Ceq* represents the carbon equivalents in the retained austenite at the annealing temperature To.

$$T1=561-33\times\{Mn\%+(Ni+Cr+Cu+Mo)/2\}$$

and T2 is expressed in terms of:

$$Ac_1=723-0.7\times Mn\%-16.9\times Ni\%+29.1\times Si\%+16.9\times Cr\%,$$

$$Ac_3=910-203\times(C\%)^{1/2}-15.2\times Ni\%+44.7\times Si\%+104\times V\%+31.5\times Mo\%-30\times Mn\%-11\times Cr\%-20\times Cu\%+70\times P\%+40\times Al\%+400\times Ti\%,$$

and the annealing temperature To, such that when $$Ceq^*=(Ac_3-Ac_1)\times C/(To-Ac_1)+(Mn+Si/4+Ni/7+Cr+Cu+1.5Mo)/6$$

is greater than 0.6, $T2=474\times(Ac_3-Ac_1)\times C/(To-Ac_1)$, and when it is 0.6 or less, $T2=474\times(Ac_3-Ac_1)\times C/\{3\times(Ac_3-Ac_1)\times C+[(Mn+Si/4+Ni/7+Cr+Cu+1.5Mo)/2-0.85)]\times(To-Ac_1)$.

In other words, when Te is less than (Tem−100)° C., almost all of the austenite is transformed into martensite, making it impossible to obtain the necessary amount of retained austenite. If Te is higher than Tem the steel sheets will be softened, making it impossible to achieve the dynamic strength expected from the static strength (TS); the upper limit for Te was therefore determined to be Tem. Also, if Te is higher than 500° C., pearlite or iron carbides are produced resulting in waste of the carbon which is indispensable for production of the retained austenite and making it impossible to obtain the necessary amount of retained austenite. On the other hand, if Toa is less than Te−50° C., additional cooling equipment may become necessary, and a greater variation will result in the material due to the difference between the temperature of the continuous annealing furnace and the temperature of the steel sheets; this temperature was therefore determined as the lower limit.

By employing the steel sheet composition and production method described above, it is possible to produce high-strength steel sheets with high flow stress during dynamic deformation, characterized in that the microstructure of the steel sheets in their final form is a composite microstructure of a mixture of ferrite and/or bainite, either of which is the dominant phase, and a third phase including retained austenite at a volume fraction between 3% and 50%, wherein the average value σdyn (MPa) of the flow stress in the range of 3~10% of equivalent strain when deformed in a strain rate range of $5\times10^2$~$5\times10^3$ (l/s) after pre-deformation of greater than 0% and less than or equal to 10% of equivalent strain, satisfies the inequality: $\sigma dyn\geqq0.766\times TS+250$ as expressed in terms of the maximum stress TS (MPa) in the static tensile test as measured in a strain rate range of $5\times10^{-4}$~$5\times10^{-3}$ (l/s) without deformation, and the work hardening coefficient between 1% and 5% of strain is at least 0.080. The high-strength steel sheets according to the invention may be made into any desired product by annealing, temper rolling, electroplating or the like.

EXAMPLES

The present invention will now be explained by way of examples.

Example 1

The 15 steel materials listed in Table 1 were heated to 1050~1250° C. and subjected to hot rolling, cooling and coiling under the production conditions listed in Table 2, to produce hot-rolled steel sheets. As shown in Tables 3 and 4, the steel sheets satisfying the component conditions and production conditions according to the invention contain from 3% to 50% of initial retained austenite in terms of volume fraction and had an M value of at least 70 and less than or equal to 250 as determined by the solid solution [C] in the retained austenite and the average Mn eq in the steel sheets, while having suitable stability as represented by a ratio more than 0.3 between the (initial retained austenite volume fraction−retained austenite volume fraction after 5% deformation)/initial retained austenite volume fraction, exhibiting excellent anti-collision safety as represented by $\sigma dyn\geqq0.766\times TS+250$, 1~5% work hardening coefficient more than 0.080 and 1~5% work hardening coefficient×yield strength more than 40, as well as suitable formability and spot weldability.

TABLE 1

Chemical components of steels

| Steel No. | | 1 | 2 | 3 | 4 | 5 | 6 | 7 | 8 |
|---|---|---|---|---|---|---|---|---|---|
| Chemical components (wt %) | C | 0.15 | 0.15 | 0.15 | 0.15 | 0.11 | 0.16 | 0.09 | 0.10 |
| | Si | 1.45 | 1.45 | 1.45 | 1.45 | 1.36 | 1.60 | 2.10 | 2.00 |
| | Mn | 0.99 | 0.79 | 0.69 | 0.79 | 1.54 | 0.90 | 1.20 | 1.10 |
| | P | 0.012 | 0.012 | 0.012 | 0.012 | 0.020 | 0.020 | 0.009 | 0.015 |
| | S | 0.002 | 0.005 | 0.002 | 0.002 | 0.003 | 0.003 | 0.001 | 0.002 |
| | Al | 0.02 | 0.02 | 0.02 | 0.02 | 0.20 | 0.01 | 0.02 | 0.02 |
| | N | 0.003 | 0.002 | 0.003 | 0.002 | 0.003 | 0.003 | 0.002 | 0.003 |
| | Al + Si | 1.47 | 1.47 | 1.47 | 1.47 | 1.56 | 1.61 | 2.12 | 2.02 |
| | Ni | | 0.4 | | | | | | |
| | Cr | | | 0.6 | | | | | |
| | Cu | | | | 0.4 | | | | |
| | Mo | | | | | 0.4 | | | |
| | Nb | | | | | | 0.04 | | |
| | Ti | | | | | | | 0.06 | |
| | V | | | | | | | | |
| | B | | | | | | | | |
| | Ca | | 0.004 | | | | | | |
| | REM | | | 0.010 | | | | | |
| | *1 | 0.99 | 1.19 | 1.29 | 1.19 | 1.94 | 0.90 | 1.20 | 1.10 |
| | Ceq | 0.32 | 0.32 | 0.32 | 0.32 | 0.40 | 0.31 | 0.29 | 0.28 |
| | Mneq | 0.99 | 0.99 | 0.99 | 0.99 | 1.74 | 0.90 | 1.20 | 1.10 |
| Transformation temperature (° C.) | Ac1 | 755 | 750 | 768 | 757 | 746 | 760 | 771 | 769 |
| | Ac3 | 868 | 868 | 871 | 866 | 879 | 875 | 932 | 904 |
| | Ar3 | 809 | 809 | 809 | 809 | 750 | 819 | 831 | 833 |
| Type | | A | A | A | A | A | A | A | B |

| Steel No. | | 9 | 10 | 11 | 12 | 13 | 14 | 15 |
|---|---|---|---|---|---|---|---|---|
| Chemical components | C | 0.10 | 0.10 | 0.15 | 0.15 | 0.35 | 0.15 | 0.19 |
| | Si | 2.00 | 2.00 | 1.98 | 0.01 | 1.50 | 0.30 | 1.10 |
| | Mn | 1.10 | 1.10 | 1.76 | 1.00 | 1.90 | 1.48 | 1.50 |
| | P | 0.015 | 0.015 | 0.016 | 0.015 | 0.015 | 0.010 | 0.090 |
| | S | 0.002 | 0.002 | 0.001 | 0.002 | 0.003 | 0.003 | 0.003 |
| | Al | 0.02 | 0.02 | 0.02 | 1.70 | 0.03 | 0.05 | 0.04 |
| | N | 0.003 | 0.002 | 0.002 | 0.002 | 0.003 | 0.003 | 0.005 |
| | Al + Si | 2.02 | 2.02 | 2.00 | 1.71 | 1.53 | 0.35 | 1.14 |
| | Ni | | | | | | | |
| | Cr | | | | | | | |
| | Cu | | | | | | | |
| | Mo | | | | | | | |
| | Nb | | | | | | | |
| | Ti | | | | | | | |
| | V | | | 0.06 | | | | |
| | B | | | | 0.001 | | | |
| | Ca | | | | | | | |
| | REM | | | | | | | |
| | *1 | 1.10 | 1.10 | 1.76 | 1.00 | 1.90 | 1.48 | 1.50 |
| | Ceq | 0.28 | 0.28 | 0.44 | 0.32 | 0.67 | 0.40 | 0.44 |
| | Mneq | 1.10 | 1.10 | 1.76 | 1.00 | 1.90 | 1.48 | 1.50 |
| Transformation temperature (° C.) | Ac1 | 769 | 769 | 762 | 713 | 746 | 716 | 739 |
| | Ac3 | 904 | 904 | 875 | 871 | 802 | 803 | 834 |
| | Ar3 | 833 | 833 | 756 | 761 | 662 | 726 | 738 |
| Type | | A | A | A | A | A | A | A |

A: Present invention
B: Comparison example
Underlined data indicate values outside of the range of the invention
*1: Mn + Ni + Cr + Cu + Mo

TABLE 2

Production conditions

| Steel No. | | 1 | 2 | 3 | 4 | 5 | 6 | 7 | 8 |
|---|---|---|---|---|---|---|---|---|---|
| Hot rolling conditions | Finishing temperature ° C. | 905 | 910 | 800 | 790 | 860 | 840 | 795 | 960 |
| | Initial steel sheet thickness | 26 | 27 | 27 | 26 | 28 | 28 | 35 | 20 |

TABLE 2-continued

| Production conditions | | | | | | | | | |
|---|---|---|---|---|---|---|---|---|---|
| | Final pass rolling speed (mpm) | 600 | 600 | 600 | 600 | 700 | 700 | 500 | 400 |
| | Final sheet thickness (mm) | 1.8 | 1.8 | 1.8 | 1.8 | 1.4 | 1.4 | 2.2 | 2.2 |
| | Strain rate (1/sec) | 150 | 150 | 150 | 160 | 190 | 190 | 100 | 90 |
| | Calculation (log A) | 13.65 | 13.60 | 14.77 | 14.91 | 13.50 | 14.46 | 14.87 | 13.15 |
| | ΔT (° C.) | 140 | 150 | 160 | 155 | 120 | 140 | 150 | 60 |
| | Condition of inequality (2) | ○ | ○ | ○ | ○ | ○ | ○ | ○ | x |
| Cooling conditions | Average cooling rate (° C./sec) | 40 | 35 | 80 | 90 | 50 | 90 | 60 | 50 |
| | Note | *1 | *1 | | | | | | |
| Coiling conditions | Coiling temperature (° C.) | 390 | 250 | 390 | 260 | 350 | 380 | 370 | 505 |
| | Condition of inequality (2) | ○ | ○ | ○ | ○ | ○ | ○ | ○ | x |

| Steel No. | | | 9 | 10 | 11 | 12 | 13 | 14 | 15 |
|---|---|---|---|---|---|---|---|---|---|
| | Hot-rolling conditions | Finishing temperature ° C. | 730 | 900 | 870 | 875 | 780 | 840 | 790 |
| | | Initial steel sheet thickness | 26 | 25 | 26 | 28 | 30 | 32 | 55 |
| | | Final pass rolling speed (mpm) | 500 | 500 | 700 | 800 | 800 | 700 | 1000 |
| | | Final sheet thickness (mm) | 2.2 | 2.2 | 1.2 | 1.2 | 1.2 | 1.2 | 1.2 |
| | | Strain rate (1/sec) | 100 | 100 | 200 | 230 | 240 | 210 | 300 |
| | | Calculation (log A) | 15.77 | 13.77 | 13.07 | 14.12 | 12.09 | 13.78 | 14.09 |
| | | ΔT (° C.) | 170 | 130 | 110 | 135 | 100 | 125 | 150 |
| | | Condition of inequality (2) | ○ | ○ | ○ | ○ | ○ | ○ | ○ |
| | Cooling conditions | Average cooling rate (° C./sec) | 60 | 50 | 50 | 55 | 60 | 50 | 100 |
| | | Note | | | | | | | |
| | Coiling conditions | Coiling temperature (° C.) | 510 | 550 | 370 | 390 | 375 | 360 | 380 |
| | | Condition of inequality (2) | x | x | ○ | ○ | ○ | ○ | ○ |

Underlined data indicate values outside of the range of the invention.
*1: 15° C./sec for 750–700° C.

TABLE 3

| Microstructure of steels | | | | | | | | | |
|---|---|---|---|---|---|---|---|---|---|
| Steel No. | | 1 | 2 | 3 | 4 | 5 | 6 | 7 | 8 |
| Dominant phase | Name | ferrite | ferrite | ferrite | ferrite | ferrite | ferrite | ferrite | bainite |
| | Circle equivaient diameter (μm) | 5.2 | 5.8 | 3.5 | 3.0 | 4.0 | 3.9 | 2.7 | 11.0 |
| Ferrite | Volume fraction (Z) | 77 | 75 | 83 | 85 | 80 | 81 | 84 | 38 |
| Retained austenite | Circle equivalent | 2.6 | 2.9 | 1.7 | 1.8 | 2.0 | 1.6 | 1.6 | 5.1 |

TABLE 3-continued

| Microstructure of steels | | | | | | | | | | |
|---|---|---|---|---|---|---|---|---|---|---|
| | diameter (μm) | | | | | | | | | |
| | Grain diameter ratio to dominant phase | | 0.50 | 0.50 | 0.49 | 0.60 | 0.50 | 0.41 | 0.59 | 0.46 |
| | C concentration (%) | | 1.20 | 1.10 | 1.29 | 1.30 | 1.21 | 1.25 | 1.25 | 1.40 |
| | Volume fraction | Without pre-deformation V(0) | 8 | 7 | 9 | 9 | 10 | 11 | 10 | 2 |
| | | After 5% pre-deformation V(5) | 4 | 3 | 5 | 6 | 5 | 7 | 6 | 2 |
| | | (V(0)−V(5)}/V(0) | 0.50 | 0.57 | 0.44 | 0.33 | 0.50 | 0.36 | 0.40 | 0.00 |
| Martensite | Circle-equivalent diameter (μm) | | — | 3.3 | — | 2.6 | 3.0 | — | — | — |
| | Volume fraction (%) | | 0 | 18 | 0 | 6 | 5 | 0 | 0 | 0 |
| Remaining composition | | | B | — | B | — | B | B | B | P |
| M value | Calculated M value | | 132 | 175 | 93 | 89 | 103 | 113 | 103 | 43 |
| | Conditions | | ○ | ○ | ○ | ○ | ○ | ○ | ○ | x |

| Steel No. | | | 9 | 10 | 11 | 12 | 13 | 14 | 15 |
|---|---|---|---|---|---|---|---|---|---|
| Dominant phase | Name | | ferrite | ferrite | ferrite | ferrite | ferrite | ferrite | ferrite |
| | Circle equivalent diameter (μm) | | deformed | 7.8 | 3.3 | 5.0 | 2.5 | 3.0 | 2.7 |
| Ferrite | Volume fraction (%) | | 88 | 60 | 59 | 79 | 50 | 40 | 70 |
| Retained austenite | Circle equivaient diameter (μm) | | — | — | 1.9 | 2.5 | 1.2 | — | 1.6 |
| | Grain diameter ratio to dominant phase | | — | — | 0.58 | 0.50 | 0.48 | — | 0.59 |
| | C concentration (%) | | — | — | 1.20 | 1.23 | 1.01 | — | 1.23 |
| | Volume fraction | Without pre-deformation V(0) | 0 | 0 | 10 | 7 | 5 | 0 | 13 |
| | | After 5% pre-deformation V(5) | 0 | 0 | 6 | 4 | 3 | 0 | 7 |
| | | (V(0)−V(5)}/V(0) | — | — | 0.40 | 0.43 | 0.40 | — | 0.46 |
| Martensite | Circle-equivalent diameter (μm) | | — | — | — | — | — | — | — |
| | Volume fraction (%) | | 0 | 0 | 0 | 0 | 0 | 0 | 0 |
| Remaining composition | | | P | P | B | B | B + P | B + P | B + P |
| M value | Calculated M value | | — | — | 106 | 119 | 183 | — | 102 |
| | Conditions | | — | — | ○ | ○ | ○ | — | ○ |

Underlined data indicate values outside of the range of the invention.
Remaining composition: B = bainite, P = pearlite

TABLE 4

| Mechanical properties of steels | | | | | | | | | |
|---|---|---|---|---|---|---|---|---|---|
| Steel No. | | 1 | 2 | 3 | 4 | 5 | 6 | 7 | 8 |
| Static tensile | TS (MPa) | 625 | 810 | 640 | 780 | 680 | 655 | 645 | 655 |
| | YS (MPa) | 530 | 560 | 490 | 510 | 510 | 530 | 500 | 560 |

TABLE 4-continued

| Mechanical properties of steels | | | | | | | | | |
|---|---|---|---|---|---|---|---|---|---|
| test (strain rate = 0.001/sec) | T.EI (Z) | 37 | 28 | 38 | 31 | 37 | 40 | 39 | 29 |
| | 1~5% of n value | 0.090 | 0.115 | 0.105 | 0.140 | 0.120 | 0.100 | 0.110 | 0.070 |
| | YS × n | 48 | 64 | 51 | 71 | 61 | 53 | 55 | 39 |
| | YR (%) | 85 | 69 | 77 | 65 | 75 | 81 | 78 | 85 |
| | TS × T.El (MPa) (%) | 23125 | 22680 | 24320 | 24180 | 25160 | 26200 | 25155 | 18995 |
| Pre-deformaion and BH treatment | Pre-deformation method | C | C | L | C | C | C | C | C |
| | Pre-deformation equivalent strain % | 5% | 5% | 5% | 3% | 5% | 7% | 5% | 5% |
| | BH treatment | yes | no | yes | yes | yes | yes | yes | yes |
| Dynamic tensile test (strain rate = 1000/sec) | σdyn | 760 | 901 | 769 | 878 | 810 | 801 | 776 | 701 |
| | Expression *1 | 31.3 | 30.5 | 28.5 | 30.5 | 39.1 | 49.3 | 31.9 | −50.7 |
| Other properties | Weiding | ok | ok | ok | ok | ok | ok | ok | ok |
| | d/do | 1.54 | 1.36 | 1.45 | 1.26 | 1.40 | 1.45 | 1.51 | 1.51 |

| Steel No. | | 9 | 10 | 11 | 12 | 13 | 14 | 15 |
|---|---|---|---|---|---|---|---|---|
| Static tensile test (strain rate = 0.001/sec) | TS (Mpa) | 570 | 575 | 855 | 610 | 1005 | 653 | 650 |
| | YS (Mpa) | 525 | 535 | 690 | 500 | 860 | 560 | 494 |
| | T.E1 (%) | 20 | 30 | 30 | 39 | 20 | 23 | 37 |
| | 1~5% of n value | 0.070 | 0.070 | 0.105 | 0.105 | 0.090 | 0.070 | 0.11 |
| | YS × n | 37 | 37 | 72 | 53 | 77 | 39 | 54 |
| | YR (%) | 92 | 93 | 81 | 82 | 86 | 86 | 76 |
| | TS × T.E1 (MPa) (%) | 11400 | 17250 | 25650 | 23790 | 20100 | 15019 | 24050 |
| Pre-deformation and BH treatment | Pre-deformation method | C | C | C | E | C | E | C |
| | Pre-equivalent strain % | 5% | 5% | 5% | 5% | 5% | 5% | 5% |
| | BH treatment | yes | yes | yes | yes | yes | yes | yes |
| Dynamic tensile test (strain rate = 1000/sec) | μdyn | 620 | 630 | 954 | 746 | 1025 | 710 | 777 |
| | Expression *1 | −66.6 | −60.5 | 49.1 | 28.7 | 5.2 | −40.2 | 29.1 |
| Other properties | Welding | ok | ok | ok | ok | poor | ok | ok |
| | d/do | 1.20 | 1.51 | 1.30 | 1.52 | 1.09 | 1.60 | 1.40 |

Underlined data indicate values outside of the range of the invention.
*1: μdyn − (0.766 × TS + 250)
C = Uniaxial tension in C direction
E = Equal biaxial tension

Example 2

The 25 steel materials listed in Table 5 were subjected to a complete hot-rolling process at Ar3 or greater, and after cooling they were coiled and then cold-rolled following acid picking. The Ac1 and Ac3 temperatures were then determined from each steel component, and after heating, cooling and holding under the annealing conditions listed in Table 6, they were cooled to room temperature. As shown in FIGS. 7 and 8, the steel sheets satisfying the production conditions and component conditions according to the invention have an M value of at least 70 and no greater than 250 as determined by the solid solution [C] in the retained austenite and the average Mn eq in the steel sheets, and all clearly exhibit excellent anti-collision safety as represented by σdyn≧0.076×TS+250 and a 1~5% strain work hardening coefficient value of at least 40.

TABLE 5

Chemical components of steels

| Steel No. | | 16 | 17 | 18 | 19 | 20 | 21 | 22 | 23 | 24 |
|---|---|---|---|---|---|---|---|---|---|---|
| Chemical components (wt %) | C | 0.05 | 0.12 | 0.20 | 0.26 | 0.12 | 0.12 | 0.12 | 0.12 | 0.12 |
| | Si | 1.20 | 1.20 | 1.20 | 1.20 | 2.00 | 1.80 | 1.20 | 1.20 | 1.20 |
| | Mn | 1.50 | 1.50 | 1.50 | 1.50 | 0.50 | 0.15 | 1.00 | 0.15 | 1.20 |
| | P | 0.010 | 0.012 | 0.008 | 0.007 | 0.008 | 0.007 | 0.013 | 0.012 | 0.010 |
| | S | 0.003 | 0.005 | 0.002 | 0.003 | 0.003 | 0.002 | 0.003 | 0.005 | 0.003 |
| | Al | 0.04 | 0.05 | 0.04 | 0.05 | 0.04 | 0.03 | 0.05 | 0.04 | 0.04 |
| | N | 0.003 | 0.002 | 0.003 | 0.002 | 0.003 | 0.003 | 0.002 | 0.003 | 0.003 |
| | Al + Si | 0.24 | 1.25 | 1.24 | 1.25 | 2.04 | 1.83 | 1.25 | 1.24 | 1.24 |
| | Ni | | | | | 0.8 | | | 1.5 | |
| | Cr | | | | | | 1.8 | | | 2.0 |
| | Cu | | | | | | | 0.6 | | |
| | Mo | | | | | | | | 0.2 | |
| | Nb | | | | | | | | | |
| | Ti | | | | | | | | | |
| | V | | | | | | | | | |
| | B | | | | | | | | | |
| | *1 | 1.50 | 1.50 | 1.50 | 1.50 | 1.30 | 1.95 | 1.60 | 1.85 | 3.20 |
| | Ceq | 0.30 | 0.37 | 0.45 | 0.51 | 0.27 | 0.30 | 0.34 | 0.29 | 0.49 |
| | Mneq | 1.50 | 1.50 | 1.50 | 1.50 | 0.90 | 1.05 | 1.30 | 1.00 | 2.20 |
| Transformation temperature (° C.) | Ac1 | 742 | 742 | 742 | 742 | 762 | 804 | 747 | 731 | 779 |
| | Ac3 | 876 | 851 | 830 | 818 | 904 | 898 | 854 | 875 | 838 |
| | Ar3 | 786 | 764 | 738 | 718 | 845 | 825 | 782 | 810 | 699 |
| Type | | A | A | A | A | A | A | A | A | A |

| Steel No. | | 24 | 26 | 27 | 28 | 29 | 29 | 31 | 32 | 33 |
|---|---|---|---|---|---|---|---|---|---|---|
| Chemical components (wt %) | C | 0.10 | 0.14 | 0.25 | 0.15 | 0.10 | 0.10 | 0.10 | 0.02 | 0.35 |
| | Si | 0.50 | 0.01 | 1.50 | 1.00 | 1.20 | 1.20 | 1.20 | 1.20 | 1.00 |
| | Mn | 1.50 | 1.50 | 2.00 | 1.70 | 1.50 | 1.50 | 1.50 | 1.50 | 1.20 |
| | P | 0.013 | 0.012 | 0.012 | 0.100 | 0.008 | 0.008 | 0.008 | 0.010 | 0.008 |
| | S | 0.005 | 0.003 | 0.005 | 0.003 | 0.003 | 0.003 | 0.003 | 0.003 | 0.003 |
| | Al | 1.20 | 1.50 | 0.04 | 0.05 | 0.04 | 0.04 | 0.04 | 0.04 | 0.05 |
| | N | 0.002 | 0.002 | 0.002 | 0.003 | 0.003 | 0.003 | 0.003 | 0.003 | 0.003 |
| | Al + Si | 1.70 | 1.51 | 1.54 | 1.05 | 1.24 | 1.24 | 1.24 | 1.24 | 1.05 |
| | Ni | | | | | | | | | |
| | Cr | | | | | | | | | |
| | Cu | | | | | | | | | |
| | Mo | | | | | | | | | |
| | Nb | | | | | 0.01 | | 0.02 | | |
| | Ti | | | | | | 0.02 | | | |
| | V | | | | | | | 0.01 | | |
| | B | | | 0.002 | | | | | | |
| | *1 | 1.50 | 1.50 | 2.00 | 1.70 | 1.50 | 1.50 | 1.50 | 1.50 | 1.20 |
| | Ceq | 0.35 | 0.39 | 0.58 | 0.43 | 0.35 | 0.35 | 0.35 | 0.27 | 0.55 |
| | Mneq | 1.50 | 1.50 | 2.00 | 1.70 | 1.50 | 1.50 | 1.50 | 1.50 | 1.20 |
| Transformation temperature (° C.) | Ac1 | 722 | 707 | 745 | 734 | 742 | 742 | 742 | 742 | 739 |
| | Ac3 | 872 | 850 | 818 | 834 | 857 | 865 | 858 | 892 | 801 |
| | Ar3 | 747 | 718 | 685 | 729 | 770 | 770 | 770 | 796 | 710 |
| Type | | A | A | A | B | A | A | A | B | B |

| Steel No. | | 34 | 35 | 36 | 37 | 38 | 39 | 40 |
|---|---|---|---|---|---|---|---|---|
| Chemical components (wt %) | C | 0.12 | 0.12 | 0.10 | 0.12 | 0.10 | 0.12 | 0.12 |
| | Si | 0.20 | 3.50 | 1.50 | 1.20 | 1.20 | 1.50 | 1.20 |
| | Mn | 1.50 | 1.50 | 1.50 | 1.50 | 1.50 | 0.10 | 1.50 |
| | P | 0.010 | 0.010 | 0.250 | 0.010 | 0.010 | 0.010 | 0.010 |
| | S | 0.002 | 0.003 | 0.003 | 0.003 | 0.003 | 0.002 | 0.002 |
| | Al | 0.04 | 0.05 | 0.04 | 0.04 | 0.04 | 0.05 | 0.04 |
| | Ni | 0.002 | 0.003 | 0.003 | 0.003 | 0.003 | 0.003 | 0.003 |
| | Al + Si | 0.24 | 3.55 | 1.54 | 1.24 | 1.24 | 1.55 | 1.24 |
| | Ni | | | | | 1.5 | 0.2 | |
| | Cr | | | | | | | |
| | Cu | | | | | 1.0 | | |
| | Mo | | | | | | | |
| | Nb | | | | | | | 0.20 |
| | Ti | | | | | | | 0.15 |
| | V | | | | | | | |
| | B | | | | 0.012 | | | |
| | *1 | 1.50 | 1.50 | 1.50 | 1.50 | 4.00 | 0.30 | 1.50 |
| | Ceq | 0.37 | 0.37 | 0.35 | 0.37 | 0.56 | 0.15 | 0.37 |
| | Mneq | 1.50 | 1.50 | 1.50 | 1.50 | 2.75 | 0.20 | 1.50 |
| Transformation | Ac1 | 713 | 809 | 751 | 742 | 717 | 762 | 742 |
| | Ac3 | 806 | 954 | 887 | 851 | 814 | 903 | 911 |

TABLE 5-continued

| Chemical components of steels | | | | | | | | | |
|---|---|---|---|---|---|---|---|---|---|
| | temperature (° C.) | Ar3 | 731 | 840 | 780 | 764 | 655 | 893 | 764 |
| | Type | | B | B | B | B | B | B | B |

A: Present invention
B: Comparison example
Underlined data indicate values outside of the range of the invention
*1: Mn + Ni + Cr + Cu + Mo

TABLE 6

| Production conditions | | | | | | | | | | | | | | |
|---|---|---|---|---|---|---|---|---|---|---|---|---|---|---|
| Steel No. | | 16 | 17 | 18 | 19 | 20 | 21 | 22 | 23 | 24 | 25 | 26 | 27 | 28 |
| Cold rolling conditions | Rolling reduction (%) | 80 | 80 | 80 | 80 | 80 | 80 | 80 | 80 | 80 | 80 | 80 | 80 | 80 |
| | Sheet thickness (mm) | 0.8 | 0.8 | 0.8 | 0.8 | 0.8 | 0.8 | 0.8 | 0.8 | 0.8 | 0.8 | 0.8 | 0.8 | 0.8 |
| Annealing conditions | Anneaiing temperature (To ° C.) | 800 | 800 | 800 | 800 | 800 | 800 | 800 | 800 | 790 | 780 | 780 | 780 | 800 |
| | Annealing time (sec) | 90 | 90 | 90 | 90 | 120 | 120 | 90 | 90 | 90 | 90 | 90 | 90 | 90 |
| | Primary cooling rate (° C./sec) | 5 | 5 | 5 | 5 | 8 | 8 | 5 | 5 | 5 | 5 | 5 | 5 | 8 |
| | Quenching start temperature (Tq ° C.) | 680 | 680 | 700 | 680 | 680 | 680 | 680 | 650 | 650 | 650 | 650 | 680 | 680 |
| | Secondary cooling rate (° C./sec) | 100 | 100 | 100 | 80 | 100 | 100 | 100 | 130 | 130 | 100 | 100 | 100 | 100 |
| | Quenching end temperature (Te ° C.) | 350 | 350 | 350 | 280 | 280 | 350 | 350 | 200 | 300 | 300 | 300 | 200 | <u>400</u> |
| | Calculated (T1 ° C.) | 512 | 512 | 512 | 512 | 531 | 526 | 518 | 528 | 488 | 512 | 512 | 495 | 505 |
| | Calculated (Ceq*) | 0.41 | 0.53 | 0.60 | 0.64 | 0.64 | 0.64 | 0.56 | 0.41 | 1.22 | 0.53 | 0.53 | 0.92 | 0.55 |
| | Calculated (T2 ° C.) | 138 | 147 | 144 | 161 | 214 | 116 | 139 | 310 | 300 | 166 | 179 | 248 | 134 |
| | Calculated (Tem ° C.) | 374 | 364 | 368 | 351 | 317 | 410 | 379 | 218 | 188 | 345 | 332 | 247 | 371 |
| | Holding temperature (Toa ° C.) | 350 | 350 | 350 | 400 | 400 | 400 | 350 | 300 | 350 | 400 | 400 | 350 | 400 |
| | Holding time (sec) | 150 | 180 | 180 | 250 | 180 | 180 | 180 | 180 | 180 | 180 | 150 | 180 | 180 |

| Steel No. | | 29 | 30 | 31 | 32 | 33 | 34 | 35 | 36 | 37 | 38 | 39 | 40 |
|---|---|---|---|---|---|---|---|---|---|---|---|---|---|
| Cold rolling conditions | Rolling reduction (%) | 68 | 68 | 68 | 80 | 80 | 80 | 80 | 80 | 80 | 70 | 70 | 70 |
| | Sheet thickness (mm) | 1.2 | 1.2 | 1.2 | 0.8 | 0.8 | 0.8 | 0.8 | 0.8 | 0.8 | 1.2 | 1.2 | 1.2 |
| Annealing conditions | Annealing temperature (To ° C.) | 780 | 780 | 780 | 800 | 760 | 780 | 850 | 800 | 800 | 780 | 800 | 800 |
| | Annealing time (sec) | 90 | 90 | 90 | 90 | 90 | 90 | 90 | 90 | 90 | 90 | 90 | 90 |
| | Primary cooling rate (° C./sec) | 8 | 5 | 5 | 5 | 5 | 5 | 5 | 5 | 5 | 5 | 5 | 5 |
| | Quenching start temperature (Tq ° C.) | 680 | 630 | 680 | 680 | 680 | 680 | 680 | 680 | 680 | 630 | 680 | 680 |
| | Secondary cooling rate (° C./sec) | 100 | 150 | 100 | 100 | 100 | 100 | 100 | 100 | 100 | 100 | 100 | 100 |
| | Quenching end temperature (Te ° C.) | 350 | 320 | 350 | 350 | 300 | 300 | 300 | 300 | 300 | 350 | 250 | 300 |
| | Calculated (T1 ° C.) | 512 | 512 | 512 | 512 | 521 | 512 | 512 | 512 | 512 | 470 | 554 | 512 |
| | Calculated (Ceq*) | 0.60 | 0.62 | 0.60 | 0.35 | 1.29 | 0.42 | 0.82 | 0.59 | 0.52 | 0.66 | 0.53 | 0.65 |
| | Calculated (T2 ° C.) | 143 | 153 | 144 | 120 | 495 | 186 | 200 | 143 | 147 | 73 | 285 | 165 |

TABLE 6-continued

| Production conditions | | | | | | | | | | | | |
|---|---|---|---|---|---|---|---|---|---|---|---|---|
| Calculated (Tem ° C.) | 369 | 359 | 368 | 392 | 26 | 326 | 311 | 369 | 364 | 398 | 270 | 346 |
| Holding temperature (Toa ° C.) | 330 | 320 | 400 | 400 | 300 | 350 | 300 | 350 | 400 | 400 | 400 | 400 |
| Holding time (sec) | 180 | 180 | 180 | 180 | 180 | 180 | 150 | 180 | 180 | 180 | 180 | 180 |

Underlined data indicate values outside of the range of the invention.

TABLE 7

| Microstructure of steels | | | | | | | | | | |
|---|---|---|---|---|---|---|---|---|---|---|
| Steel No. | | 16 | 17 | 18 | 19 | 20 | 21 | 22 | 23 | 24 |
| Dominant phase | Name | ferrite | ferrite | ferrite | ferrite | ferrite | ferrite | ferrite | ferrite | ferrite |
| | Circle equivalent diameter (μm) | 7.2 | 6.4 | 5.3 | 5.5 | 8.1 | 6.9 | 5.1 | 5.5 | 5.1 |
| Ferrite | Volume fraction (%) | 85 | 65 | 48 | 41 | 80 | 55 | 69 | 82 | 55 |
| Retained austenite | Circle equivalent diameter (μm) | 2.8 | 2.6 | 1.9 | 1.2 | 2.8 | 2.8 | 2.9 | 2.1 | 1.3 |
| | Grain diameter ratio to dominant phase | 0.39 | 0.41 | 0.36 | 0.22 | 0.35 | 0.41 | 0.57 | 0.38 | 0.25 |
| | C concentration (%) | 1.29 | 1.19 | 1.21 | 1.16 | 1.08 | 1.10 | 1.28 | 1.03 | 1.04 |
| | Volume fraction Before pre-deformation V(0) | 4 | 10 | 15 | 20 | 9 | 10 | 8 | 12 | 10 |
| | After 5% pre-deformation V(5) | 2 | 5 | 8 | 7 | 3 | 3 | 3 | 4 | 3 |
| | {V(0)–V(5)}/V(0) | 0.50 | 0.50 | 0.47 | 0.65 | 0.67 | 0.70 | 0.63 | 0.67 | 0.70 |
| Martensite | Circle-equivalent diameter (μm) | 1.6 | 1.3 | — | 2.5 | 3.2 | 3.1 | 1.9 | 2.8 | 3.1 |
| | Volume fraction (%) | 1 | 1 | 0 | 5 | 3 | 4 | 1 | 6 | 4 |
| Remaining | composition | B | B | B | B | B | B | B | B | B |
| M value | Calculated M value | 77 | 177 | 113 | 132 | 185 | 171 | 89 | 206 | 160 |
| | Conditions | ○ | ○ | ○ | ○ | ○ | ○ | ○ | ○ | ○ |

| Steel No. | | 25 | 26 | 27 | 28 | 29 | 30 | 31 | 32 | 33 |
|---|---|---|---|---|---|---|---|---|---|---|
| Dominant phase | Name | ferrite | ferrite | ferrite | ferrite | ferrite | ferrite | ferrite | ferrite | ferrite |
| | Circle equivalent diameter (μm) | 7.1 | 5.3 | 3.8 | 5.3 | 6.8 | 7.1 | 6.6 | 10.9 | 4.1 |
| Ferrite | Volume fraction (%) | 73 | 66 | 41 | 55 | 71 | 70 | 73 | 92 | 25 |
| Retained austenite | Circle equivalent | 1.8 | 1.9 | 1.2 | 1.3 | 2.5 | 2.7 | 2.7 | — | 2.8 |
| | Grain diameter ration to dominant phase | 0.25 | 0.36 | 0.32 | 0.25 | 0.37 | 0.38 | 0.39 | — | 0.68 |
| | C concentration (%) | 1.17 | 1.16 | 1.05 | 1.48 | 1.10 | 1.23 | 1.19 | — | 1.42 |
| | Volume fraction Before pre-deformation V(0) | 7 | 10 | 21 | 11 | 8 | 7 | 7 | 0 | 18 |
| | After 5% pre-deformation V(5) | 3 | 4 | 8 | 8 | 3 | 3 | 3 | 0 | 15 |
| | {V(0)–V(5)}/V(0) | 0.57 | 0.60 | 0.62 | 0.27 | 0.63 | 0.57 | 0.57 | — | 0.17 |
| Martensite | Circle-equivalent diameter (μm) | 3.3 | 2.6 | 4.2 | 1.6 | 2.9 | 4.1 | 2.9 | — | 4.2 |
| | Volume fraction (%) | 4 | 4 | 15 | 1 | 4 | 2 | 4 | 0 | 26 |
| Remaining | composition | B | B | B | B | B | B | B | B | B + P |
| M value | Calculated M value | 129 | 131 | 164 | −12 | 159 | 101 | 120 | — | 31 |
| | Conditions | ○ | ○ | ○ | X | ○ | ○ | ○ | X | X |

TABLE 7-continued

Microstructure of steels

| Steel No. | | | 34 | 35 | 36 | 37 | 38 | 39 | 40 |
|---|---|---|---|---|---|---|---|---|---|
| Dominant phase | Name | | ferrite | ferrite | ferrite | ferrite | ferrite | ferrite | bainite |
| | Circle equivalent diameter (μm) | | 6.2 | 5.5 | 6.8 | 5.9 | 4.8 | 10.4 | 5.9 |
| Ferrite | Volume fraction (%) | | 70 | 55 | 66 | 58 | 32 | 80 | 65 |
| Retained austenite | Circle equivalent diameter (μm) | | — | 2.1 | 2.6 | 2.1 | 1.2 | — | 1.9 |
| | Grain diameter ratio to dominant phase | | — | 0.38 | 0.38 | 0.36 | 0.25 | — | 0.32 |
| | C concentration (%) | | — | 1.38 | 1.41 | 1.33 | 1.35 | — | 1.42 |
| | Volume fraction | Before pre-deformation V(0) | _0 | 8 | 7 | 7 | 6 | _0 | 6 |
| | | After 5% pre-deformation V(5) | _0 | 6 | 5 | 5 | 5 | _0 | 5 |
| | | (V(0)–V(5)}/V(0) | — | 0.25 | 0.29 | 0.29 | 0.17 | — | 0.17 |
| Martensite | Circle-equivalent diameter (μm) | | 2.9 | 3.1 | 2.7 | 3.6 | 3.6 | — | 3.8 |
| | Volume fraction (%) | | 6 | 2 | 5 | 3 | 3 | 0 | 6 |
| Remaining composition | | | B | B | B | B | B | B | B |
| M value | Calculated M value | | — | 38 | 25 | 59 | _9 | — | 21 |
| | Conditions | | X | X | X | X | X | X | X |

Underlined data indicate values outside of the range of the invention.

TABLE 8

Mechanical properties of steels

| Steel No. | | 16 | 17 | 18 | 19 | 20 | 21 | 22 | 23 | 24 |
|---|---|---|---|---|---|---|---|---|---|---|
| Static tensile test (strain rate = 0.001/sec) | TS (MPa) | 576 | 653 | 812 | 936 | 681 | 669 | 637 | 732 | 748 |
| | YS (MPa) | 397 | 477 | 609 | 552 | 463 | 435 | 452 | 447 | 471 |
| | T.E1 (%) | 43 | 35 | 31 | 25 | 33 | 34 | 35 | 32 | 30 |
| | 1~5% of n value | 0.117 | 0.107 | 0.095 | 0.095 | 0.105 | 0.112 | 0.116 | 0.112 | 0.103 |
| | YS × n | 47 | 51 | 58 | 52 | 49 | 49 | 52 | 50 | 49 |
| | YR (%) | 0.69 | 0.73 | 0.75 | 0.59 | 0.68 | 0.65 | 0.71 | 0.61 | 0.63 |
| | TS × T.E1 (MPa) (%) | 24768 | 22855 | 25172 | 23400 | 22473 | 22746 | 22295 | 23424 | 22440 |
| Pre-deformation and BH treatment | Pre-deformation method | C | C | L | C | C | C | C | C | E |
| | Pre-deformation equivalent strain (%) | 5 | 5 | 10 | 5 | 5 | 3 | 5 | 5 | 10 |
| | BH treatment | yes | no | yes | yes | yes | yes | yes | yes | no |
| Dynamic tensile test (strain rate = 1000/ sec) | σdyn | 712 | 771 | 890 | 986 | 823 | 815 | 761 | 842 | 849 |
| | Expression *1 | 20.8 | 20.8 | 18.0 | 19.0 | 51.4 | 52.5 | 23.1 | 31.3 | 26.0 |
| Welding | | ok | ok | ok | ok | ok | ok | ok | ok | ok |

| Steel No. | | 25 | 26 | 27 | 28 | 29 | 30 | 31 | 32 | 33 |
|---|---|---|---|---|---|---|---|---|---|---|
| Static tensile test (strain | TS (MPa) | 597 | 619 | 1176 | 752 | 667 | 679 | 703 | 502 | 1156 |
| | YS (MPa) | 406 | 402 | 635 | 647 | 420 | 475 | 464 | 437 | 694 |
| | T.E1 (%) | 37 | 35 | 23 | 32 | 35 | 34 | 30 | 31 | 17 |
| | 1–5% of n | 0.122 | 0.116 | 0.092 | 0.122 | 0.118 | 0.112 | 0.126 | 0.144 | 0.079 |

TABLE 8-continued

Mechanical properties of steels

| | | | | | | | | | | |
|---|---|---|---|---|---|---|---|---|---|---|
| rate = 0.001/sec) | value | | | | | | | | | |
| | YS × n | 50 | 47 | 58 | 79 | 50 | 53 | 58 | 63 | 55 |
| | YR (%) | 0.68 | 0.65 | 0.54 | 0.86 | 0.63 | 0.70 | 0.66 | 0.87 | 0.60 |
| | TS × T.E1 (MPa) (%) | 22089 | 21665 | 27048 | 24064 | 23345 | 23086 | 21090 | 15562 | 19652 |
| Pre-deformation and BH treatment | Pre-deformation method | C | L | C | C | C | E | C | C | C |
| | Pre-deformation equivalent strain (%) | 5 | 5 | 1 | 5 | 5 | 5 | 5 | 5 | 5 |
| | BH treatment | yes | no | yes | yes | no | yes | yes | yes | yes |
| Dynamic tensile test (strain rate = 1000/sec) | σdyn | 742 | 765 | 1162 | 801 | 806 | 792 | 810 | 592 | 1026 |
| | Expression *1 | 34.7 | 40.8 | 11.2 | −25.0 | 45.1 | 21.9 | 21.5 | −42.5 | −109.5 |
| Welding | | ok | ok | ok | ok | ok | ok | ok | ok | poor |

| | Steel No. | | 34 | 35 | 36 | 37 | 38 | 39 | 40 |
|---|---|---|---|---|---|---|---|---|---|
| | Static tensile test (strain rate = 0.001/sec) | TS (MPa) | 570 | 865 | 849 | 716 | 916 | 515 | 756 |
| | | YS (MPa) | 353 | 675 | 501 | 437 | 641 | 453 | 514 |
| | | T.E1 (%) | 25 | 31 | 32 | 34 | 22 | 32 | 26 |
| | | 1–5% of n value | 0.141 | 0.079 | 0.077 | 0.086 | 0.132 | 0.164 | 0.142 |
| | | YS × n | 50 | 53 | 39 | 38 | 85 | 74 | 73 |
| | | YR (%) | 0.62 | 0.78 | 0.59 | 0.61 | 0.70 | 0.88 | 0.68 |
| | | TS × T.E1 (MPa) (%) | 14250 | 26815 | 27168 | 24344 | 20152 | 16480 | 19656 |
| | Pre-deformation and BH treatment | Pre-deformation method | C | C | C | C | C | C | C |
| | | Pre-deformation equivalent strain (%) | 5 | 5 | 5 | 5 | 5 | 5 | 5 |
| | | BH treatment | yes | yes | yes | yes | yes | yes | yes |
| | Dynamic tensile test (strain rate = 1000/sec) | σdyn | 632 | 867 | 855 | 768 | 901 | 598 | 789 |
| | | Expression *1 | −54.6 | −45.6 | −45.3 | −30.5 | −50.7 | −46.5 | −40.1 |
| | Welding | | ok | ok | ok | ok | poor | ok | ok |

Underlined data indicate values outside of the range of the invention.
*1: βdyn − (0.766 × TS + 250)
C = Uniaxial tension in C direction
L = Uniaxial tension in L direction
E = Equal biaxial tension The microstructure was evaluated by the following methods.

Identification of the ferrite, bainite, martensite and remaining structure, observation of the location and measurement of the mean grain diameter (circle equivalent diameter) and volume fraction were accomplished using a 1000 magnification optical micrograph with the thin steel sheet rolling direction cross-section etched with a nital reagent and the reagent disclosed in Japanese Unexamined Patent Publication No. 59-219473.

The mean circle equivalent diameter of the retained austenite was determined from a 1000 magnification optical micrograph, with the rolling direction cross-section etched with the reagent disclosed in Japanese Patent Application No. 3-351209. The position was also observed from the same photograph.

The volume fraction of the retained austenite (Vγ: percentage unit) was calculated according to the following equation, upon Mo-Kα X-ray analysis.

$$V\gamma=(2/3)\{100/(0.7\times\alpha(211)/\gamma(220)+1)\}+(1/3)\{100/(0.78\times\alpha(211)/\gamma(311)+1)\}$$

where α(211), γ(220), α(211) and γ(311) represent pole intensities.

The C concentration of the retained γ (Cγ: percentage unit) was calculated according to the following equation, upon determining the lattice constant (unit: Angstroms) from the reflection angle on the (200) plane, (220) plane and (311) plane of the austenite using Cu-KαX-ray analysis.

$$C\gamma=(\text{lattice constant}-3.572)/0.033$$

The properties were evaluated by the following methods.

A tensile test was conducted according to JIS5 (gauge length: 50 mm, parallel part width: 25 mm) with a strain rate of 0.001/sec, and upon determining the tensile strength (TS), yield strength (YS), total elongation (T.El) and work hardening coefficient (n value for strain of 1~5%), the YS×work hardening coefficient, the yield rate (YR=YS/TS×100) and the TS×T.El were calculated.

The stretch flanging property was measured by expanding a 20 mm punched hole from the burrless side with a 30° cone punch, and determining the hollow extension ratio (d/do) between the hollow diameter at the moment at which the crack penetrated the sheet thickness and (d) the original hollow diameter (do, 20 mm).

The spot weldability was judged to be unsuitable if a spot welding test piece bonded at a current of 0.9 times the expulsion current using an electrode with a tip radius of 5 times the square root of the steel sheet thickness underwent peel fracture when ruptured with a chisel.

INDUSTRIAL APPLICABILITY

As explained above, the present invention makes it possible to provide in an economical and stable manner high-strength hot-rolled steel sheets and cold-rolled steel sheets for automobiles which provide previously unobtainable excellent anti-collision safety and formability, and thus offers a markedly wider range of objects and conditions for uses of high-strength steel sheets.

What is claimed is:

1. A high strength steel sheet with high flow stress during dynamic deformation, characterized in that the steel sheet contains, in terms of wt %, C at from 0.03% to 0.3%, either or both Si and Al at a total of from 0.5% to 3.0% with the remainder Fe as a primary component, and the microstructure of the steel sheet in the final form is a composite microstructure of a mixture of ferrite and/or bainite, either of which is the dominating phase, and the third phase including retained austenite at a volume fraction between 3% and 50%, wherein the average value of σdyn (MPa) of the flow stress in the range of 3–10% of equivalent strain when deformed in a strain rate range of $5\times10^2$–$5\times10^3$ (1/sec) after pre-deformation of greater than 0% and less than or equal to 10% of equivalent strain, satisfies the inequality: σdyn≧0.766×TS+250 as expressed in terms of the maximum stress TS (MPa) in the static tensile test as measured in a strain rate range of $5\times10^{-4}$–$5\times10^{-3}$ (1/sec) without deformation, the value (M) determined by the solid solution (C) in the retained austenite and the average Mn equivalents of the steel material {Mneq=Mn+(Ni+Cr+Cu+Mo)/2}, defined by the equation M=678−428×(C)−33 Mneq is at least 70 and not greater than 250, the difference between the retained austenite volume fraction without pre-deformation and the retained austenite volume fraction after applying a pre-deformation of 5% of equivalent strain is at least 30% of the retained austenite volume fraction without pre-deformation, and the work hardening coefficient between 1% and 5% of a strain is at least 0.080 and of a strain yield strength is at least 40.

2. A high strength steel sheet with high flow stress during dynamic deformation according to claim 1, wherein the steel sheet further contains, in terms of wt %, one or more from among Mn, Ni, Cr, Cu and Mo at a total of from 0.5% to 3.5%, and one or more from among Nb, Ti, V, P, and B, with one or more from among Nb, Ti, V at a total of no greater than 0.3%, P at no greater than 0.3% and B at no greater than 0.01%, and one or more of Ca at from 0.0005% to 0.01% and REM at from 0.005% to 0.05%.

3. A steel sheet according to claim 1, wherein the mean grain diameter of said retained austenite is no greater than 5 μm; the ratio of the mean grain diameter of said retained austenite and the mean grain diameter of the ferrite or bainite in the dominating phase is no greater than 0.6, and the average grain diameter of the dominating phase is no greater than 10 μm.

4. A steel sheet according to claim 1, wherein the volume fraction of martensite is 3–30%, and the mean grain diameter of said martensite is no greater than 10 μm.

5. A steel sheet according to claim 1, wherein the volume fraction of the ferrite is at least 40%.

6. A steel sheet according to claim 1, wherein the yield ratio is no greater than 85% and the value of the tensile strength×total elongation is at least 20,000.

7. A method for producing a high strength hot-rolled steel sheet with high flow stress during dynamic deformation where the microstructure of the steel sheet in the final form is a composite microstructure of a mixture of ferrite and/or bainite, either of which is the dominating phase, and the third phase including retained austenite at a volume fraction between 3% and 50%, wherein the average value σdyn (MPa) of the flow stress in the range of 3–10% of equivalent strain when deformed in a strain rate range of $5\times10^2$–$5\times10^3$ (1/sec) after pre-deformation of greater than 0% and less than or equal to 10% of equivalent strain satisfies the inequality: σdyn≧0.766×TS+250 as expressed in terms of the maximum stress TS (MPa) in the static tensile test as measured in a strain rate range of $5\times10^{-4}$–$5\times10^{-3}$ (1/sec) without deformation, the value (M) determined by the solid solution (C) in the retained austenite and the average Mn equivalents of the steel material {Mn eq=Mn+(Ni+Cr+Cu+Mo)/2}, defined by the equation M=678−428×(C)−33 Mneq is at least 70 and not greater than 250, the difference between the retained austenite volume fraction without pre-deformation and the retained austenite volume fraction after applying a pre-deformation of 5% of equivalent strain is at least 30% of the retained austenite volume fraction without pre-deformation, and the work hardening coefficient between 1% and 5% of a strain is at least 0.080 and of a strain yield strength is at least 40, which is characterized in that the method comprises the steps of:

continuously casting a molten metal into a slab containing, in terms of wt %, C at from 0.03% to 0.3%, either or both Si and Al at a total of from 0.5% to 3.0% with the remainder Fe as a primary component, directly hot rolling the slab, with or without slab reheating step, into strip, finish hot rolling the strip at a finishing temperature of $Ar_3$−50° C. to $Ar_3$+120° C., cooling the hot rolled strip with an average cooling rate of at least 5° C./sec, and coiling the cooled strip at a temperature of no greater than 500° C.

8. The method according to claim 7, wherein, at the finishing temperature for the hot-rolling in a range of $Ar_3$−50° C. to $Ar_3$+120° C., the hot rolling is carried out so that the metallurgy parameter: A satisfies inequalities (1) and (2) below, the subsequent average cooling rate in the run-out table is at least 5° C./sec, and the coiling is accomplished so that the relationship between said metallurgy parameter: A and the coiling temperature (CT) satisfies inequality (3) below:

$$9 \leqq \log A \leqq 18 \quad (1)$$

$$\Delta T \geqq 21\times\log A - 178 \quad (2)$$

$$CT \leqq 6\times\log A + 312 \quad (3).$$

9. A method for producing a high strength cold-rolled steel sheet with high flow stress during dynamic deformation where the microstructure of the steel sheet in the final form is a composite microstructure of a mixture of ferrite and/or bainite, either of which is the dominating phase, and the third phase including retained austenite at a volume fraction between 3% and 50%, wherein the average value σdyn (MPa) of the flow stress in the range of 3–10% of equivalent strain when deformed in a strain rate range of $5\times10^2$–$5\times10^3$ (1/sec) after pre-deformation of greater than 0% and less than or equal to 10% of equivalent strain, satisfies the inequality: $\sigma dyn \geqq 0.766 \times TS+250$ as expressed in terms of the maximum stress TS (MPa) in the static tensile test as measured in a strain rate range of $5\times10^{-4}$–$5\times10^{-3}$ (1/sec) without deformation, the value (M) determined by the solid solution (C) in the retained austenite and the average Mn equivalents of the steel material {Mneq=Mn+(Ni+Cr+Cu+Mo)/2}, defined by the equation M=678−428×(C)−33 Mneq is at least 70 and not greater than 250, the difference between the retained austenite volume fraction without pre-deformation and the retained austenite volume fraction after applying a pre-deformation of 5% of equivalent strain is at least 30% of the retained austenite volume fraction without pre-deformation, and the work hardening coefficient between 1% and 5% of a strain is at least 0.080 and of a strain yield strength is at least 40, which is characterized in that the method comprises the steps of;

continuously casting a molten metal into a slab containing, in terms of wt %, C at from 0.03% to 0.3%, either or both Si and Al at a total of from 0.5% to 3.0% with the remainder Fe as a primary component, directly hot rolling the slab, with or without slab reheating step, into strip, finish hot rolling the strip at a finishing temperature of $Ar_3$−50° C. to $Ar_3$+120° C., cooling the hot rolled strip with an average cooling rate at least 5° C./sec, coiling the cooled strip at a temperature of no greater than 500° C., acid pickling a rewind strip, cold rolling the acid pickled strip, continuously annealing the cold rolled strip at a temperature of from $0.1\times(Ac_3-Ac_1)+Ac_1$° C. to $AC_3$+50° C. for 10 seconds to 3 min, cooling the annealed strip to a primary cooling stop temperature in the range of 550–720° C. at a primary cooling rate of 1–10° C./sec, further cooling the primary cooled strip to a secondary cooling stop temperature in the range of 150–450° C. at a secondary cooling rate of 10–200° C./sec, holding the secondary cooled strip at a temperature in the range of 150–500° C. for 15 seconds to 20 minutes, and cooling the strip to room temperature.

10. A method for producing a high strength cold-rolled steel sheet with high flow stress during dynamic deformation where the microstructure of the steel sheet in the final form is a composite microstructure of a mixture of ferrite and/or bainite, either of which is the dominating phase, and the third phase including retained austenite at a volume fraction between 3% and 50%, wherein the average value $\sigma dyn$ (Mpa) of the flow stress in the range of 3–10% of equivalent strain when deformed in a strain range of $5\times10^{2}$–$5\times10^{3}$ (1/sec) after pre-deformation of greater than 0% and less than or equal to 10% of equivalent strain, satisfied the inequality: $\sigma dyn \geqq 0.766 \times TS+250$ as expressed in terms of the maximum stress TS (MPa) in the static tensile test as measured in a strain rate range of $5\times10^{-4}$–$5\times10^{-3}$ (1/sec) without deformation, the value (M) determined by the solid solution (C) in the retained austenite and the average Mn equivalents of the steel material {Mneq=Mn+(Ni+Cr+Cu+Mo)/2}, defined by the equation M=678−428×(C)−33 Mneq is at least 70 and not greater than 250, the difference between the retained austenite volume fraction without pre-deformation and the retained austenite volume fraction after applying a pre-deformation of 5% of equivalent strain is at least 30% of the retained austenite volume fraction without pre-deformation, and the work hardening coefficient between 1% and 5% of a strain is at least 0.080 and of a strain yield strength is at least 40, which is characterized in that the method comprises the steps of;

continuously casting a molten metal into a slab containing, in terms of wt %, C at from 0.03% to 0.3%, either or both Si and Al at a total of from 0.5% to 3.0% with the remainder Fe as a primary component, directly hot rolling the slab, with or without slab reheating step, into strip, finish hot rolling the strip at a finishing temperature of $Ar_3$−50° C. to $Ar_3$+120° C., cooling the hot rolled strip with an average cooling rate at least 5° C./sec, coiling the cooled strip at a temperature of no greater that 500° C., acid pickling a rewind strip, cold rolling the acid pickled strip, continuously annealing the strip at a temperature of from $0.1\times(Ac_3-Ac_1)+Ac_1$° C. to $Ac_3$+50° C. for 10 seconds to 3 min, primary cooling the annealed strip to a secondary cooling start temperature Tq in the range of 550–720° C. at a primary cooling rate of 1–10° C./sec, further cooling the cooled strip to a secondary cooling stop temperature Te in the range of from the temperature Tem, which is determined by the component and annealing temperature To to 500° C. at a secondary cooling rate of 10–200° C./sec, holding the secondary cooled strip at a temperature Toa in the range of Te−50° C. to 500° C. for 15 seconds to 20 minutes, and cooling the strip to room temperature.

11. A method for producing a high strength cold-rolled steel sheet with high flow stress during dynamic deformation according to claims 9 or 10, wherein the steel sheet further contains, in terms of wt %, one or more from among Mn, Ni, Cr, Cu and Mo at a total of from 0.5% to 3.5%, and one or more from among Nb, Ti, V, P, and B, with one or more from among Nb, Ti, V at a total of no greater than 0.3%, P at no greater that 0.3% and B at no greater than 0.01%, and one or more of Ca at from 0.0005% to 0.01% and REM at from 0.005% to 0.05%.

* * * * *